US007354144B2

(12) United States Patent
Hatasa et al.

(10) Patent No.: US 7,354,144 B2
(45) Date of Patent: Apr. 8, 2008

(54) LIQUID CONTAINER, LIQUID SUPPLY SYSTEM AND RECORDING APPARATUS USING THE LIQUID CONTAINER, AND CIRCUIT MODULE FOR LIQUID CONTAINER AND SUBSTRATE

(75) Inventors: Nobuyuki Hatasa, Kawasaki (JP); Kenjiro Watanabe, Ohta-ku (JP); Kimiyuki Hayasaki, Yokohama (JP)

(73) Assignee: Canon Kabushiki Kaisha, Tokyo (JP)

( * ) Notice: Subject to any disclaimer, the term of this patent is extended or adjusted under 35 U.S.C. 154(b) by 328 days.

(21) Appl. No.: 11/304,603

(22) Filed: Dec. 16, 2005

(65) Prior Publication Data

US 2006/0139422 A1 Jun. 29, 2006

(30) Foreign Application Priority Data

Dec. 24, 2004 (JP) ..... 2004-374485

(51) Int. Cl.
*B41J 2/175* (2006.01)
*B41J 29/393* (2006.01)

(52) U.S. Cl. ..... 347/86; 347/87; 347/19

(58) Field of Classification Search ..... 347/86, 347/87, 19

See application file for complete search history.

(56) References Cited

U.S. PATENT DOCUMENTS

| | | | | |
|---|---|---|---|---|
| 5,083,137 | A * | 1/1992 | Badyal et al. | 347/14 |
| 6,619,776 | B2 * | 9/2003 | Yoshiyama et al. | 347/7 |
| 6,935,716 | B2 | 8/2005 | Hatasa et al. | 347/19 |
| 7,128,380 | B2 | 10/2006 | Hatasa et al. | 347/7 |
| 7,213,914 | B2 * | 5/2007 | Anma et al. | 347/86 |
| 7,237,881 | B2 * | 7/2007 | Hayasaki et al. | 347/86 |
| 2005/0179750 | A1 | 8/2005 | Hayasaki et al. | 347/86 |
| 2005/0219303 | A1 * | 10/2005 | Matsumoto et al. | 347/19 |
| 2006/0244795 | A1 | 11/2006 | Hayasaki et al. | 347/86 |
| 2006/0290722 | A1 | 12/2006 | Kitagawa et al. | 347/7 |

FOREIGN PATENT DOCUMENTS

| | | |
|---|---|---|
| JP | 4-275156 | 9/1992 |
| JP | 5-266224 | 10/1993 |
| JP | 2002-7374 | 1/2002 |
| JP | 2002-301829 | 10/2002 |

* cited by examiner

*Primary Examiner*—Stephen Meier
*Assistant Examiner*—Rene Garcia, Jr.
(74) *Attorney, Agent, or Firm*—Fitzpatrick, Cella, Harper & Scinto

(57) ABSTRACT

The power consumption of the entire recording apparatus is decreased in the structure that the recording element and the light emitting portion are provided on the ink tank, processes according to the amount of the residual ink is performed by communicating information stored in the recording element to the main body of the recording apparatus, and the condition of the ink tank can be informed by emitting light. The ink tank comprises the recording element, the light emitting portion, and the controlling portion driving the the recording element and the light emitting portion at the appropriate timing, and further comprises the voltage level chanigng menas for supplying the appropriate voltage to each thereof. Relatively low voltage is constantly supplied to the controlling portion, thereby driving the recording element and the light emitting portion at the appropriate timing. Accordingly, appropriate processings can be divided according to necessary events during the series of processings for the recording apparatus, thereby realizing the power saving effect.

12 Claims, 28 Drawing Sheets

LIQUID CONTAINER, LIQUID SUPPLY SYSTEM AND RECORDING APPARATUS USING THE LIQUID CONTAINER, AND CIRCUIT MODULE FOR LIQUID CONTAINER AND SUBSTRATE

BACKGROUND OF THE INVENTION

1. Field of the Invention

This invention relates to a liquid container, a liquid supply system and a recording apparatus using the liquid container, a circuit module for a liquid container and a substrate, and a liquid storage cartridge and particularly relates to the liquid container, the liquid supply system and the recording apparatus using the liquid container, the circuit module for a liquid container, and the substrate which are structured that information of a condition of the liquid container such as the condition of an amount of the residual ink in an ink tank used for the ink jet recording is displayed by driving a light emitting portion such as an LED.

2. Related Background Art

Recently, diffusion of digital cameras contributes to increase the number of non-PC recording, namely, printing by directly connecting to ink jet printers (hereinafter simply the recording apparatus or printer) functioning as both the digital camera and the recording apparatus without a personal computer (PC). Furthermore, the number of non-PC recording, namely, printing by directly connecting to the ink jet printer, is increasing where the printing job is performed by directly loading a card type information recording medium, removable from the digital camera, in the printer so as to transfer data. Generally, it is known that the amount of the residual ink within the ink tank is to be confirmed on a monitor through a PC. However, it is beneficial and especially advantageous for the non-PC recording to learn about the condition of the ink tank such as the amount of the residual ink within the ink tank and information as to whether the ink tank is properly mounted without using the PC. When the user uses the printer and for example notices that the amount of ink is low (little), the user can replace the ink tank prior to the printing job in order to obviate a problem of practically not being able to record due to the insufficient amount of ink during the recording job. If the user notices about the inappropriate setting of the ink tank, the user can remount the ink tank prior to the printing job, thereby ascertaining the setting of the ink tank.

Conventionally, a display element such as the LED is known as a structure of informing the user of the condition of the ink tank. Japanese Patent Application Laid-Open No. H04-275156 discloses that two LEDs and recording means (hereinafter memory) are provided in the ink tank integrated with a recording head and that each LED flashes in correspondence to the information of two levels of the amount of the residual ink recorded in the memory. Japanese Patent Application Laid-Open No. 2002-301829 discloses that a lamp flashes corresponding to the information of the amount of the residual ink as well. In that reference, it is also disclosed that the above-explained lamp is provided in each of four ink tanks used in the printer.

Recently, there is a demand for printers to be more power saving from ecology standpoint. Due to the fact that mobile notebook computers and digital cameras have been widespread, the printers are used under the static environment such as in an office and a house as well as under the dynamic environment functioning as mobile printers, thereby widening the operating environment. Different from the static environment where power supply is not a major concern because the printer may be connected to a general household power supply and commercial power supply, the dynamic environment forces the printer to operate under the limited power supply such as by batteries. Accordingly, in order to structure such mobile printers, more power saving solution is in demand.

Japanese Patent Application Laid-Open Nos. H04-275156 and 2002-301829 simply disclose conditions where display devices on the ink tanks are mounted in the printer bodies. In consideration of the structure that the ink tank is mountable on and removable from the printer body, the power is supplied from the printer to the display device or memory under this condition.

Here, the display device and the memory mounted on the ink tank each need to be controlled to be driven and accessed with an appropriate timing, and therefore proper power supply is highly desirable for the power saving standpoint. However, Japanese Patent Application Laid-Open Nos. H04-275156 and 2002-3018290 do not suggest such a power saving structure.

Generally, recent printers perform color recording using inks of black, yellow, magenta, and cyan, and because of the needs for higher picture quality, colors such as light color magenta and light color cyan have been used in addition to the above four colors. Some printers use inks of spot colors such as red and blue. In these cases, the printers need to carry plural ink tanks corresponding to the number of ink colors.

As such, when the printer carries plural ink tanks with the memories storing various printer information, all memories need to be electrically connected with each other to transfer signals with a main control portion (such as a CPU) of the printer body. Therefore, as the number of ink tanks mounted thereon, namely, the number of memories, increases, signal lines to be connected thereto must also increase.

Also, there is a structure where each circuit, which connects between an electric contact point at the ink tank side for sending and receiving signals and an electric contact point at the printer, is provided on a individually predetermined position in the above plural ink tanks. In this structure, if the color information is detected as communicating with the ink tank, which indicates that the amount of ink is little and the display portion of the ink tank at the corresponding mounting position is controlled to flash, the user accurately recognizes the little amount of the residual ink in the ink tank based on the displayed information.

However, in the structure that the signal line is individually provided at every ink tank or mounting position, the number of signal lines further increases so as to perform the above control. It is not preferable the tendency of the increase in the number of mounted ink tanks, and this structure raises problems of more complicated wiring and higher cost. Especially, considering that the different elements, which require different amount of electric energy for driving, are mounted on the ink tank, each element must be supplied with proper electric energy. In this case, the electric supply lines are arranged to correspond to this structure, which increases the number of wiring and creates the complicated structure.

SUMMARY OF THE INVENTION

This invention is made to resolve the above problems, and objects thereof are as follows. A storage element (information retention portion) and an informing portion such as the light emitting portion are provided on the cartridge type ink tank (liquid container) which is mountable on and removable from the printer (recording apparatus), and the information stored in the storage element is communicated to the main body of the recording apparatus. Accordingly, process corresponding to the condition of the respective ink tanks (for example, the amount of the residual ink) is possible, and the power consumption of the entire printer decreases because of the structure of such as the light emitting portion being able to report the condition of the ink tank.

Another object of the invention is to restrict the increase of the number of wirings for connecting with main body of the recording apparatus side and the complexity when mounting plural ink tanks. Accordingly, the invention provides a liquid container mountable on and removable from a recording apparatus which is capable of mounting plural liquid containers, and which has a apparatus side contact point electrically connectable to a contact point of the liquid container and an electric circuit electrically being connected to the apparatus side contact point and having a wiring to supply a power supply voltage to the plural liquid containers, the liquid container further comprising: the contact point electrically connectable to the apparatus side contact point; an information retention portion capable of retaining at least an individual information with respect to the liquid container; a informing portion; a driving portion for driving the informing portion; a controlling portion capable of accessing the information retention portion in response to a command containing the individual information from the recording apparatus and performing a drive control of the driving portion so as to inform a condition of the liquid container; and voltage level changing means for supplying the voltage as changing a level of the power supply voltage relative to at least one of the controlling portion, the informing portion, and the information retention portion according to the voltage necessary for driving the controlling portion, the informing portion, and the information retention portion.

According to the invention, by positioning the voltage level changing means, the proper voltage can be supplied to each element (controlling portion, informing portion, and information retention portion) with different driving voltage. Relatively lower voltage is constantly supplied to the controlling portion, thereby driving the information retention portion and the informing portion at the appropriate timing. Thus, plural liquid containers do not require high voltage simultaneously, and the processing appropriate for the necessary events during the series of process of the recording apparatus can be divided, thereby realizing the power saving effects.

Furthermore, the recording apparatus side is able to supply constant electricity via single power line, thereby restricting the increase in the number of the signal lines connecting to the recording apparatus body side when using plural liquid containers. The invention can flexibly deal with the increase in the number of ink tanks. Therefore, a wide variety of processes at the plural ink tanks are possible without high capacity power supply in the main body of the recording apparatus.

BRIEF DESCRIPTION OF THE DRAWINGS

FIG. 21B is a view explaining the movement of a carriage to the position for the light checking as closing the body cover after turning the light on;

DETAILED DESCRIPTION OF THE PREFERRED EMBODIMENT

Embodiments of the invention will be explained next with reference to the accompanied drawings.

Example of Mechanical Structure in Which The Invention can be Employed

Firstly, one example of the mechanical structure of the cartridge and the ink jet recording apparatus using the cartridge in which the invention can be employed will be explained.

Ink Tank (FIG. 1A to FIG. 5B)

Figure 1B:
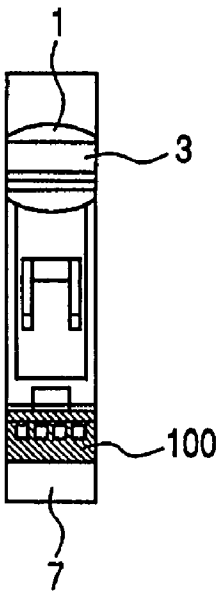
FIG. 1B is a plan view of the ink tank in which the invention can be employed.
Figure 1A:
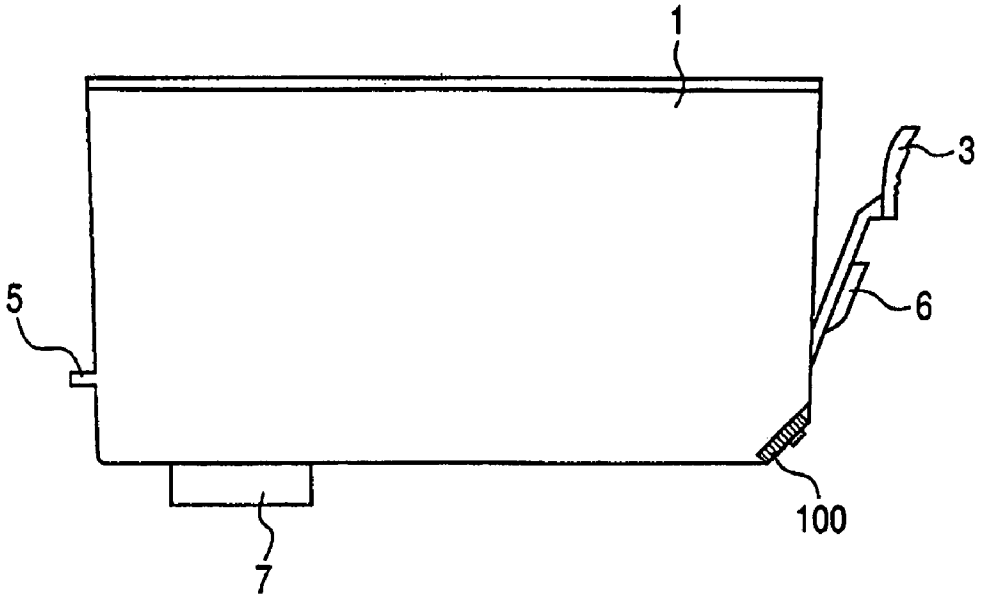
FIG. 1A is a side view of the ink tank in which the invention can be employed.
Figure 1C:
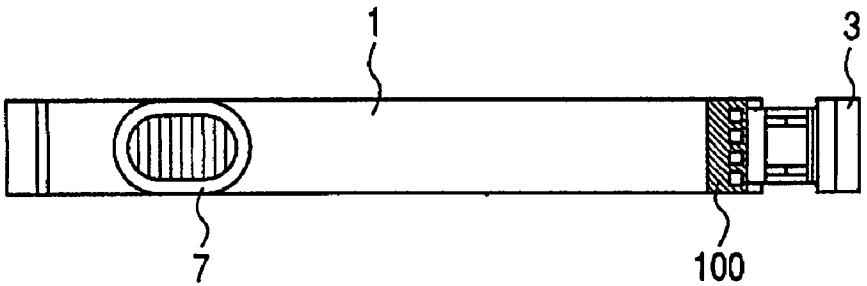
FIG. 1C is a bottom view of the ink tank in which the invention can be employed.
Figure 2:
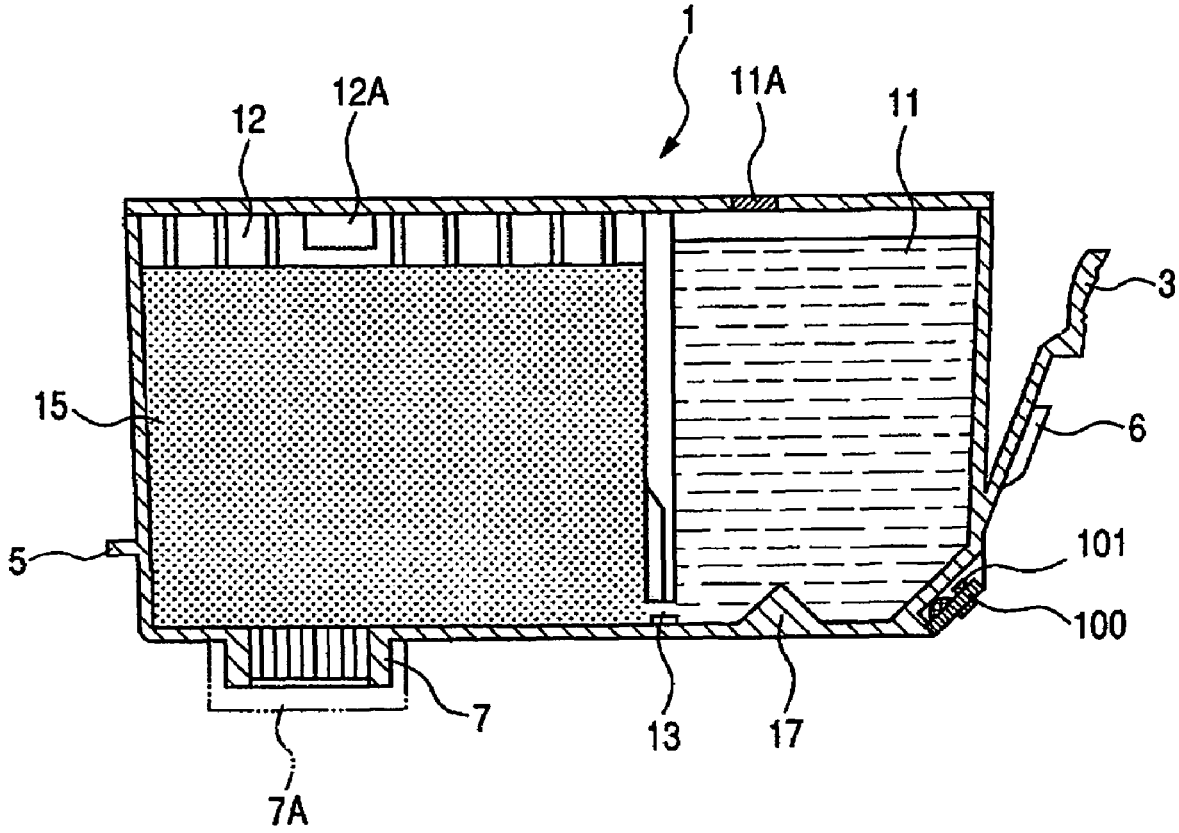
FIG. 2 is a side cross-section view of the ink tank in which the invention can be employed.

FIGS. 1A to 1C are a side view, a plan view, and a bottom view of the ink tank according to one embodiment of the liquid container according to the invention respectively, and FIG. 2 is a side cross-section view thereof. In the invention, the front face of the ink tank means a surface facing the user so as to operate such as mounting and removing thereof and to provide the information to the user (later explained LED emission).

In FIG. 1A to 1C, the ink tank 1 of this embodiment has a supporting member 3, which is supported at a lower portion of a front face of the ink tank 1. The supporting member 3 is made of resin and is integrally formed with an exterior of the ink tank 1. The supporting member 3 can be displaced around the supporting portion thereof as mounting the ink tank 1 on the later explained tank holder. A first engaging portion 5 and a second engaging portion 6 (which is integrated with supporting member 3 in this embodiment), which are engageably fitting in engagement portion at the tank holder side, are formed at a back surface side and a front face side of the ink tank 1, and the engagement therebetween retains the ink tank 1 in the tank holder, thereby maintaining the engagement. Operation of the mounting will be explained later along with FIGS. 7A to 7C.

An ink supply port 7 is provided at the bottom surface of the ink tank 1 in order to supply the ink as joining with an ink inlet of the later explained recording head when mounting on the tank holder. A basic substrate as a main part of this embodiment is provided at a meeting point between this bottom surface and the front face at the bottom surface side of the supporting portion of the supporting member 3. A shape of the basic substrate may be such as a chip-like shape and a plate-like shape, which will be explained below as a substrate 100.

FIG. 2 is a side cross-section view of the ink tank 1. Inside of the ink tank 1 is divided into an ink containing chamber 11, which is positioned at the front face side where the supporting member 3 and the substrate 100 are provided, and a negative pressure generating material containing chamber 12, which is positioned at the back surface side and communicates to the ink supply port 7. The ink containing chamber 11 and the negative pressure generating material chamber 12 are connected via a communicating port 13. The ink is stored in the ink containing chamber 11 while the negative pressure generating material containing chamber 12 has an ink absorbing body 15 (hereinafter porous material just for convenience) such as a sponge and fiber bulk materials for impregnating and retaining the ink therein. This porous material 15 should be sufficient to prevent the ink from leaking from an ink discharging portion by balancing with a retaining force of a meniscus formed at an ink discharging nozzle portion and is to generate appropriate negative pressure within a range possible.

An atmosphere communicating portion 12A is provided at the upper surface of the negative pressure generating material chamber 12 so as to relax the increase of the negative pressure as supplying the ink to the recording head and to maintain the negative pressure within a predetermined range.

The ink tank 1 as shown in FIG. 2 may be produced as injecting the ink inside after preparing the ink tank 1 with the later explained substrate thereon. The ink inlet hole for executing this method for injecting the ink therein, for example, may be formed on the upper surface of the ink containing chamber 11. Here, after injecting the ink therein, the ink inlet hole may be sealed by a sealing material 11A.

Upon using the ink tank 1 and as consuming the ink contained therein, for example, the sealing material 11A should be removed after the amount of the residual ink contained therein is substantially consumed. The inlet hole may be reformed by breaking the sealing material, and the ink may be injected in the ink tank 1 with an injector, in which the inlet hole may be resealed with a sealing material 11A or with alternative materials as necessary. Alternatively, instead of using the preformed inlet hole, for example, an opening may be formed on a different location of the upper surface of the ink containing chamber 11. After the ink may be injected therein through this opening, the opening may be sealed as necessary.

Furthermore, the sealing material 7A, which prevents the ink leakage while transporting or storing the manufactured ink tank 1, is mountable on and removable from the ink supply port 7. This sealing material 7A may be such as a cap and a tape material as long as giving certain sealing effects and being removable when mounting the ink tank on the recording head. Also, when the ink tank is removed from the recording head after starting to use the same, the sealing material 7A or the alternative may be used to seal the ink supply port 7.

Here, the invention is not limited to the internal structure of the ink tank 1 which is divided into such as the porous material chamber and the chamber in which the ink is stored as it is. For example, practically, overall inside of the ink tank may be filled with the porous material. Also, instead of the porous material, as means to generate the negative pressure, the ink may be filled in a bag-like member made of elastic materials such as rubber so as to generate a tensile force in a direction to expand the capacity, thereby providing the negative pressure to the ink inside the ink tank 1 with the tensile force generated by the bag-like member. Alternatively, at least one portion in the ink containing space may be formed with the elastic material; the ink only is injected and contained therein; and a spring force is applied to the elastic material so as to generate the negative pressure. For these alternatives, the ink tank may be produced by performing the similar ink injection as explained above. Also in this case, the atmosphere communicating portion for introducing the outside air into the ink containing space so as to relax the negative pressure within the ink containing space, which is increasing as supplying the ink to the recording head, and to maintain the negative pressure within the preferable predetermined range. Also, the atmosphere communicating portion may be used to inject the ink.

A detecting element 17 is provided at the bottom portion of the ink containing chamber 11 possibly facing with a later explained residual ink detecting sensor provided at the apparatus side when mounting the ink tank 1 thereon. In this embodiment, the residual ink detecting sensor is an optical sensor using a light emitting portion and a photoreceptor portion. The detecting element 17 is made of a transparent or semitransparent material and is in a prism-shape with a predetermined angle and slant faces so as to appropriately reflect the light from the light emitting portion to the later explained photoreceptor portion when the ink is not contained therein.

Figure 3A:
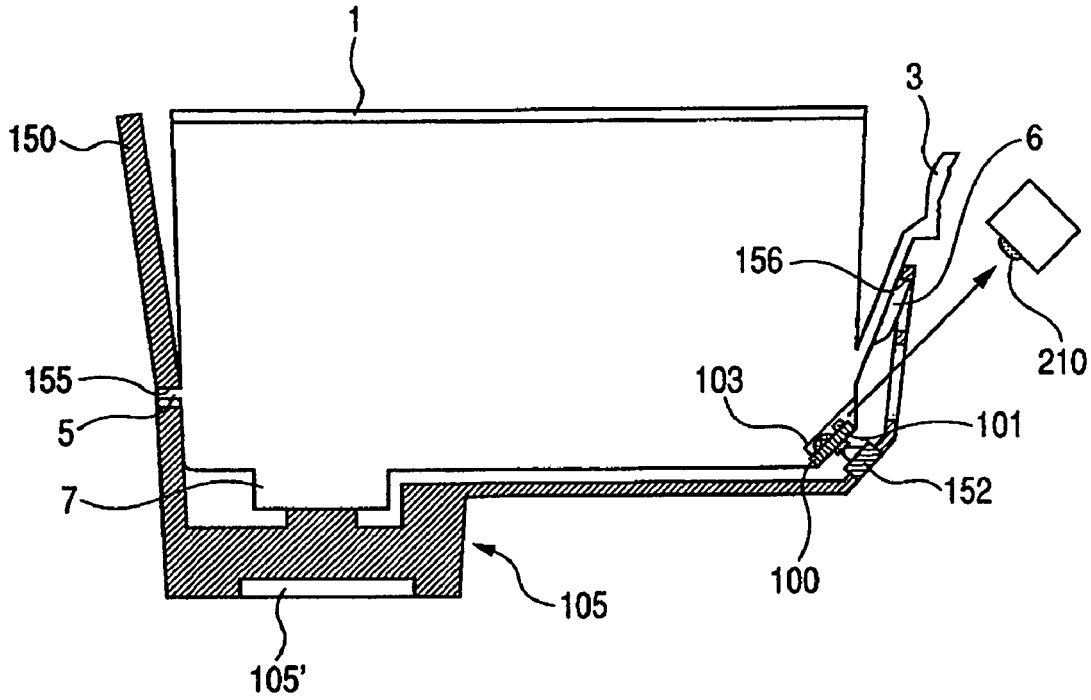
FIGS. 3A and 3B are model side views explaining a summary of the functions regarding the substrate disposed in the ink tank in which the invention can be employed.
Figure 3B:
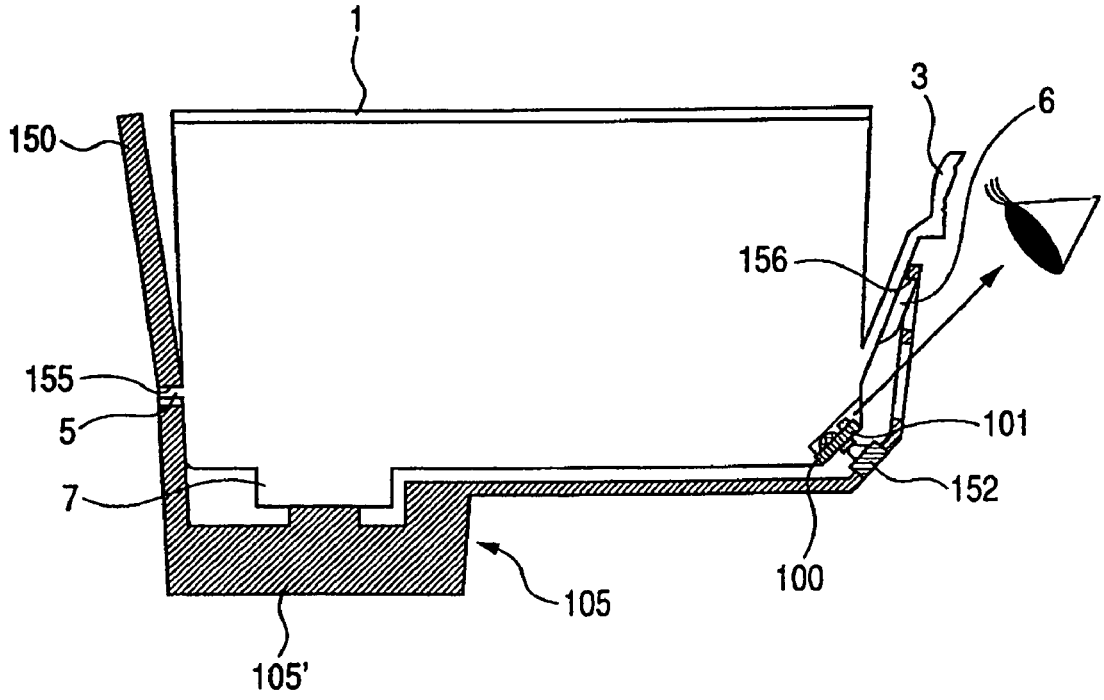
Figure 4A:
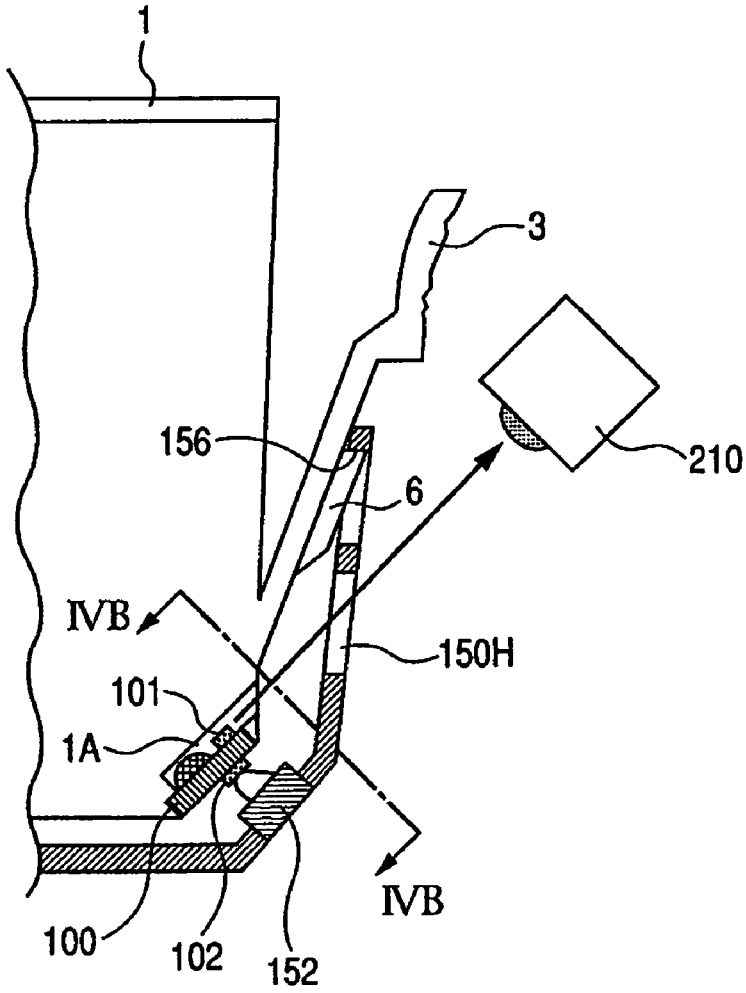
FIG. 4A is an enlarged view of a main part of FIG. 3A.
Figure 4B:
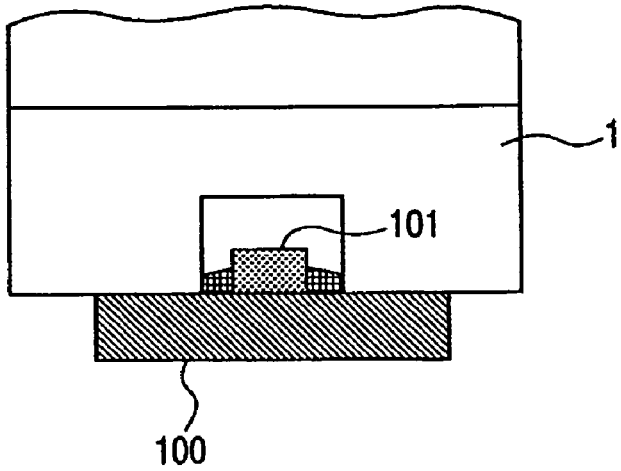
FIG. 4B is a view from an arrow B of FIG. 4A.
Figure 5B:
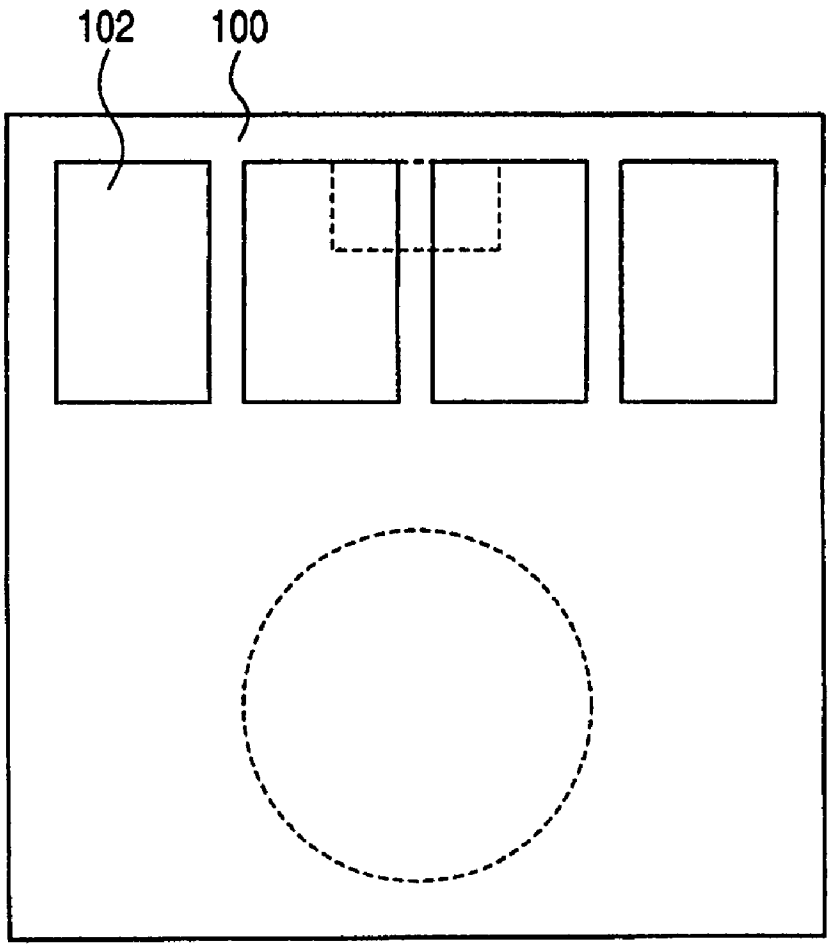
FIG. 5B is a plan view of an example of the control board to be installed in the ink tank in which the invention can be employed.
Figure 5A:
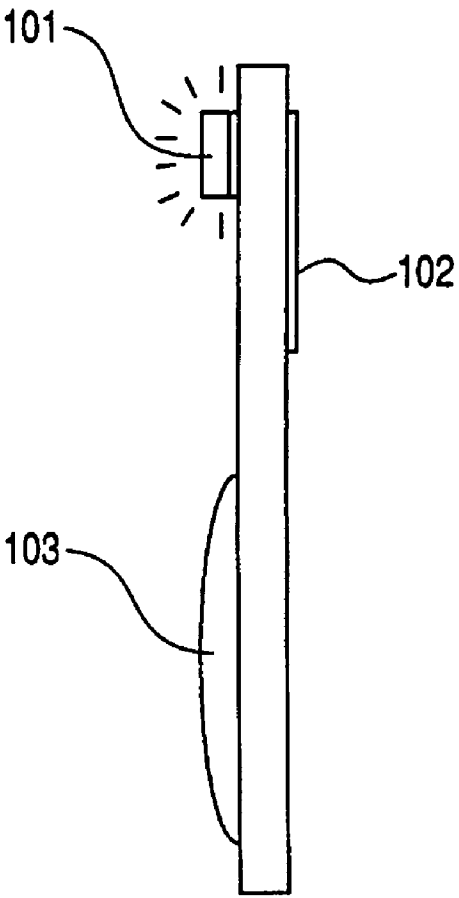
FIG. 5A is a side view of an example of the control board to be installed in the ink tank in which the invention can be employed.

The structure and functions of the substrate 100 as the main part of this embodiment will be explained with reference to FIG. 3A to FIG. 5B. Here, FIGS. 3A and 3B are model side views explaining the summary of the functions regarding the substrate positioned in the ink tank in which the invention can be employed. FIGS. 4A and 4B are an enlarged view of the main part of FIGS. 3A and 3B and a view from the arrow IVB of FIG. 4A respectively. FIGS. 5A and 5B are a side view and a plan view of the example of the control substrate 100 to be installed in the ink tank according to a first embodiment, respectively.

The first engaging portion 5 and the second engaging portion 6 of the ink tank 1 engage with the first looking portion 155 and the second looking portion 156 of the holder 150 integrated with the recording head unit 105 with the recording head 105'. As such, the ink tank 1 is mounted on the holder 150 and is fixed thereon. At that time, a contact point (hereinafter connector) 152 provided on the holder 150 contacts with an electrode pad 102 as shown in FIG. 5B functioning as a contact point provided on a surface facing outside of the substrate 100 installed on the ink tank 1, thereby enabling the electric connection therebetween.

A first light emitting portion 101 emitting visible light such as the LED and a control unit 103 controlling the light emitting portion 101 are provided on a surface of the substrate 100 positioned facing inside of the ink tank 1. The control unit 103 controls the emission of the first light emitting portion 101 by an electric signal transmitted from the connector 152 via the pad 102. FIG. 5A shows the condition where the control unit 103 is installed on the substrate 100 and then sealing agent is applied to cover thereon for the protection. When a memory element storing the information relating to the ink tank color and the amount of the residual ink contained in the ink tank 1 is mounted, the memory element may be mounted in the same location to be covered by the sealing agent.

As explained above, the substrate 100, namely, the main part of this embodiment, is disposed around a meeting point between the bottom surface and the front face of the ink tank 1 and at is a lower side of the supporting portion of the supporting member 3. A slant surface is formed to bridge the two surfaces of the ink tank 1 around the position where the substrate 100 is disposed. Accordingly, as the first light emitting portion 101 emits light, a portion of the light runs along the slant surface from the front face side of the ink tank 1 toward outside.

By using the above explained arrangement of the substrate 100, the first light emitting portion 101 can inform the user as directly displaying the certain information relating to the ink tank 1 in addition to the recording apparatus (a host device such as a computer to which the recording apparatus is connected). That is, as shown in FIG. 3A, the photoreceptor portion is arranged around an end of a scanning range of the carriage on which the holder 150 is mounted and a position to intercept the light emitting in the upper right direction of the figure, and light from the first light emitting portion 101 is controlled when the carriage reaches to the position. Accordingly, certain information relating to the ink tank 1 may be recognized from the light interception contents of the photoreceptor portion at the recording apparatus side. Also, for example, by controlling the light emission of the first light emitting portion 101 as positioning the central region of the scanning range, as shown in FIG. 3B, the user is able to recognize the certain information relating to the ink tank 1 by viewing the light emitting condition.

The certain information of the ink tank (liquid container) 1 means the information as to whether the ink tank 1 is being mounted or not (namely, whether the mounting is complete or not) and whether the mounting position is appropriate or not (whether the ink tank 1 is correctly mounted on a mounting position on a predetermined holder for the corresponding ink color). Furthermore, it also may display the information such as whether there is any residual ink (whether sufficient amount of ink exists or not) by emitting or not emitting the light and by condition of the emitted light. The details of the light emission control and the display of the information will be explained in the later section relating to the control structure.

FIGS. 4A and 4B show a preferable structure for the arrangement and operation of the substrate 100 and/or the first light emitting portion 101. That is, preferably, a space 1A is reserved around a portion of the ink tank 1 facing the surface of the substrate 100 on which the first light emitting portion 101 and the control unit 103 are provided. That is, the space 1A is preferably formed at least along a light axis (arrow) in order to smoothly lead the light emitted by the first light emitting portion 101 to the first photoreceptor portion 210 as a structural element of position detection means to detect the mounting position of the ink tank and the visual range of the user. Also, for the same reasoning, the light axis is not cut off by properly deciding the position and shape of the supporting member 3. Furthermore, the holder 150 has a hole (or a light transparent portion) 150H to secure the light axis.

The first light emitting portion 101 may appropriately be arranged so as to increase the amount of light toward the subject direction. Alternatively, an additional member such as a lens may be installed in the light path to improve the directivity. In this embodiment, the light emitting portion itself becomes a display but the displaying function may be separated and the emitting portion thereof may be provided at a predetermined position on the front face of the ink tank 1 (for example, the supporting member 3 or an operating portion 3M which the user especially operates). Alternatively, the emitting portion may be provided at a predetermined portion on the front face of the tank holder 150, and a member leading the light toward the emitting portion may be provided on the substrate, the ink tank or the tank holder. Furthermore, the position of the first photoreceptor portion 210 is not limited to as shown in FIG. 3A and the later explained FIG. 10 and may be positioned on other members. In such a case, the position should be determined in consideration of the direction for the user for viewing and should be such that the light is emitted or led in the direction toward the first photoreceptor portion.

Ink Tank Mounting Portion (FIG. 6 to FIG. 8B)

Figure 6:
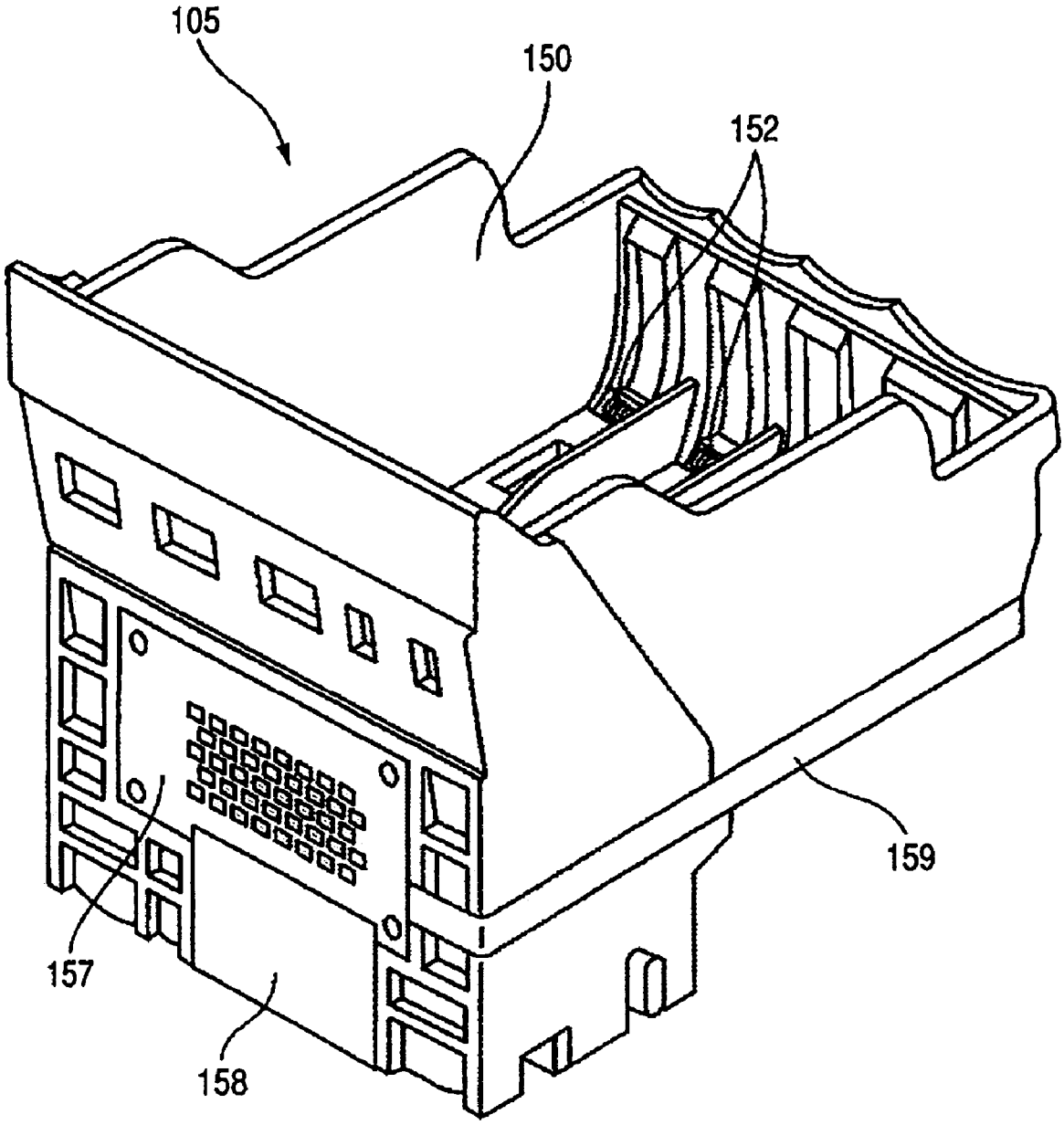
FIG. 6 is a perspective view of an example of the recording head unit with a holder where the ink tank is to be mounted in which the invention can be employed.
Figure 7B:
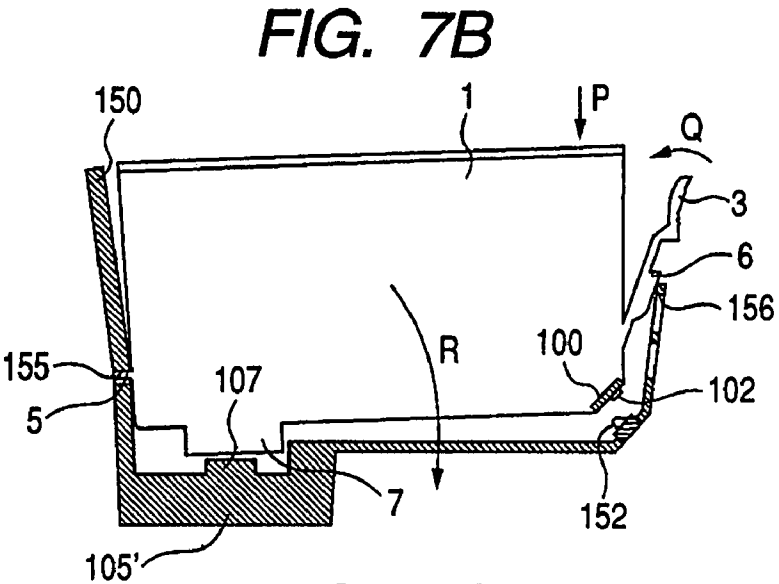
FIGS. 7A, 7B, and 7C are model side views explaining an operation as mounting and removing the ink tank, in which the invention can be employed, on/from the holder as shown in FIG. 14.
Figure 7C:
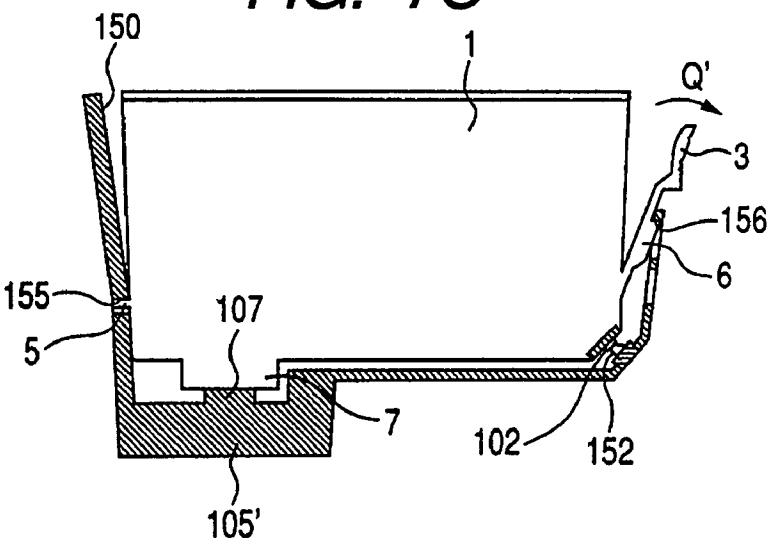
Figure 7A:
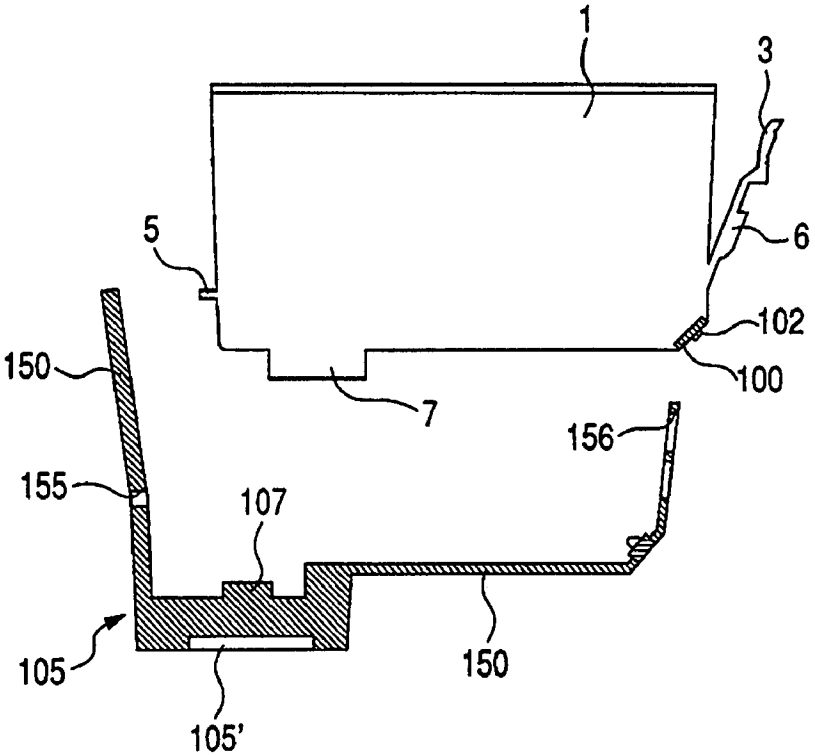

FIG. 6 is the perspective view of an example of the recording head unit relating to the first embodiment where the ink tank is mountable and removable. FIGS. 7A to 7C show model side views explaining an operation as mounting the ink tank to the recording head unit.

The recording head unit 105 is comprised of the holder 150 mountably/removably retaining plural (four in the figures) ink tanks and the recording head 105' arranged at the bottom surface side (not shown in FIG. 6). By mounting the ink tank on the holder 150, the ink inlet 107 at the recording head side positioned at the holder bottom is jointed with the ink supply port 7 at the ink tank side, thereby forming the ink channel (communicating path) therebetween.

For the recording head 105', a thermoelectric transducing element is provided within a liquid channel constituting a nozzle, and an electric pulse to be a recording signal is applied thereto to give the heat energy to the ink. At that time, the pressure, when bubbling (boiling) is generated due to the change of ink phase, may be utilized for the ink discharge. The later explained electric contact point (not shown in the figures) for signal transmission provided at the carriage 203 contacts the electric contact point 157 at the recording head unit 105 side, and the recording signal is transmitted to the thermoelectric transducing element drive circuit of the recording head 105' via a wiring section 158. A wiring section 159 is extending from the electric contact point 157 to the connector 152

When mounting the ink tank 1 on the recording head unit 105, the ink tank 1 is handled at the upper side of the holder 150 as shown in FIG. 7A. The first engaging portion 5 projecting from the back surface side of the ink tank 1 is mounted to penetrate through the first looking portion 155 forming a penetrating bore at the back surface side of the holder 150 on the bottom surface of the holder as shown in FIG. 7B. Under this condition, if an upper end of the front face side of the ink tank 1 is pushed down along an arrow P, the ink tank 1 rotates toward a direction of an arrow R with the pivot point between the first engaging portion 5 and the first looking portion 155 as the fulcrum, thereby lowering the position of the front face side of the ink tank 1. During this process, as the side surface of the second engaging portion 6 provided on the supporting member 3 at the front face side of the ink tank is being pushed against the second looking portion 156 provided at the holder front face side, the supporting member 3 moves toward a direction of an arrow Q.

Then, the upper surface of the second engagement portion 5 reaches the lower side of the second looking portion 156, the supporting member 3 moves toward a direction Q' by its own resilient force, and the second engaging portion 6 is locked in the second looking portion 156. Under this condition, as shown in FIG. 7C, the second engagement portion 155 urges the ink tank 1 elastically toward a horizontal direction via the supporting member 3, thereby abutting the back surface of the ink tank 1 against the back surface of the holder 150. A movement of the ink tank 1 to upper side is restricted by the first looking portion 155 engaging with the first engaging portion 5 and the second looking portion 156 engaging with the second engaging portion 6. Here, the mounting process of the ink tank 1 is completed, and at that time the ink supply port 7 and the ink inlet 107 or the pad 102 and the connector 152 are connected with each other.

If a lever operation is considered as an example, in the process of the mounting operation as shown in FIG. 7B, an engagement point between the first engaging portion 5 and the first looking portion 155 becomes a pivot point and the front face side of the ink tank 1 becomes a power point. A joint of the ink supply port 7 and the ink inlet 107 is a pressure cone apex, which is positioned between the power point and the pivot point, preferably adjacent to the pivot point. Accordingly, the ink supply port 7 is pushed against the ink inlet 107 with a large force due to the rotation of the ink tank 1. Generally, a resilient member such as a filter, an absorber, and a packing, which is relatively flexible, is provided at the joint between the two for the purpose of ensuring the ink communication property and also prevention of the ink leakage.

Accordingly, in consideration of the object of employing the arrangement, it is preferable to employ the structural arrangement and mounting process according to this embodiment and make the members deformed by applying comperatively big force. Also, if the mounting operation is completed, floating of the ink tank 1 may be prevented by the first looking portion 155 engaging with the first engaging portion 5 and the second looking portion 156 engaging with the second engaging portion 6. Accordingly, the reversion of the elastic material is restricted, thereby maintaining the proper deformation of the members.

The pad 102 and the connector 152 functioning as the contact point may be relatively high rigid electrically conducting material such as metal, and there should be sufficient electric connectivity exist therebetween. It is not preferable to abut the pad 102 and the connector 152 as applying overforce in view of the damage preventive measure and durability. In this embodiment, the abutting force therebetween is kept low by arranging the two away from the pivot point as much as possible, namely, adjacent to front face of the ink tank.

For that purpose, the pad of the substrate is proposed to be arranged on the member immediately around the front face on the bottom surface of the ink tank 1. To the contrary, the pad of the substrate may be arranged on the front face of the ink tank. However, in either case, there is a limit to the arrangement on the substrate of the first light emitting portion 101 for the sufficient emission to the first photoreceptor portion 210 and the eyes of the user. When arranging the substrate on the member on the bottom surface of the ink tank immediately around the front face thereof, immediately before completing the mounting process of the ink tank 1, the pad 102 and the connector 152 face but approach to be connected with each other. A large mounting force is necessary so as to maintain the good electrical conducting connection regardless of the condition of the surfaces of the pad 102 and the connector 152, which possibly gives the overforce on the pad 102 and the connector 152 as a result. If the ink leaks from the joint between the ink supply port 7 and the ink inlet 107, the leaked ink runs through the bottom surface of the ink tank to possibly reach the pad 102 and the connector 152. Arranging the substrate on the front face of the ink tank makes it difficult for the ink tank 1 to be removed from the apparatus main body.

In this embodiment, the substrate 100 is arranged on a meeting point of the bottom surface and the front face on the slant surface connecting the two surfaces. Here, under the condition that the pad 102 abuts against the connector 152 immediately before completing the mounting process, the proportion of the force only at the abutting portion is considered. In this case, a reaction force (namely, an upward force in the vertical direction), which is applied to the pad 102 by the connector 152 in proportion to the mounting force affecting on the lower side of the vertical direction, becomes a component force of the actual abutting pressure (a force in the vertical direction relative to the slant surface). Accordingly, when the user presses down the ink tank toward the mounting complete position, the increase in the mounting force of the ink tank to perform the electric connection between the substrate and the connector may be kept low, thereby eliminating the possibility of significantly degrading the operability of the user.

If the ink tank 1 is pressed toward the mounting complete position (namely, position where the first engaging portion 5 engages and fits with the first looking portion 155 and the second engaging portion 6 engages and fits with the second looking portion 156), the pressure thereof also creates the component force in the direction parallel to a plane surface of the substrate 100 (namely, a force sliding the pad 102 on the connector 152), thereby offering the better electric connectivity between the two members in the mounting complete position. Under this condition, because the electrically connected portion is positioned higher than the bottom surface of the ink tank, it is little fear that the leaked ink runs up thereto. Furthermore, under this condition, an optical axis from the first light emitting portion 101 to the first photoreceptor position 210 and the eyes of the user are secured.

That is, the structural arrangement of the electrically connecting portion as in this embodiment is preferable for securing the light emission path when the emission from the first light emitting portion 101 is shared with and received by the first photoreceptor portion and the eyes of the user. Furthermore, this embodiment is appropriate in relation to various points such as the strength of the mounting force of the ink tank, security of the electrically connecting condition, and protecting from the leaked ink.

The first embodiment or modification example thereof according to the invention relating to the installation structure of the ink tank is not limited to FIG. 6.

The explanation of such will be made with reference to FIGS. 8A and 8B. FIG. 8A is the perspective view showing another example of the structure of the recording head unit operating the recording action as receiving the ink from the ink tank and a carriage therefore, and FIG. 8B is the perspective view showing the jointed condition of the carriage and the recording head unit.

This embodiment of recording head unit 405, unlike the above explained holder 150 which retains and fix the entire ink tank, does not comprise the holder portion corresponding to the front face side of the ink tank, and the second engagement portion and connector arranged therein as shown in FIG. 8A. Other than these changes, the structure of this embodiment is almost same as the previous embodiment, which comprises the ink inlet 107 to be connected to the ink supply port 7 on the bottom surface, the first looking portion 155 at the back surface side, and the electrically connecting portion for signal transmission on the reverse side thereof (not shown in the figures).

Figure 8B:
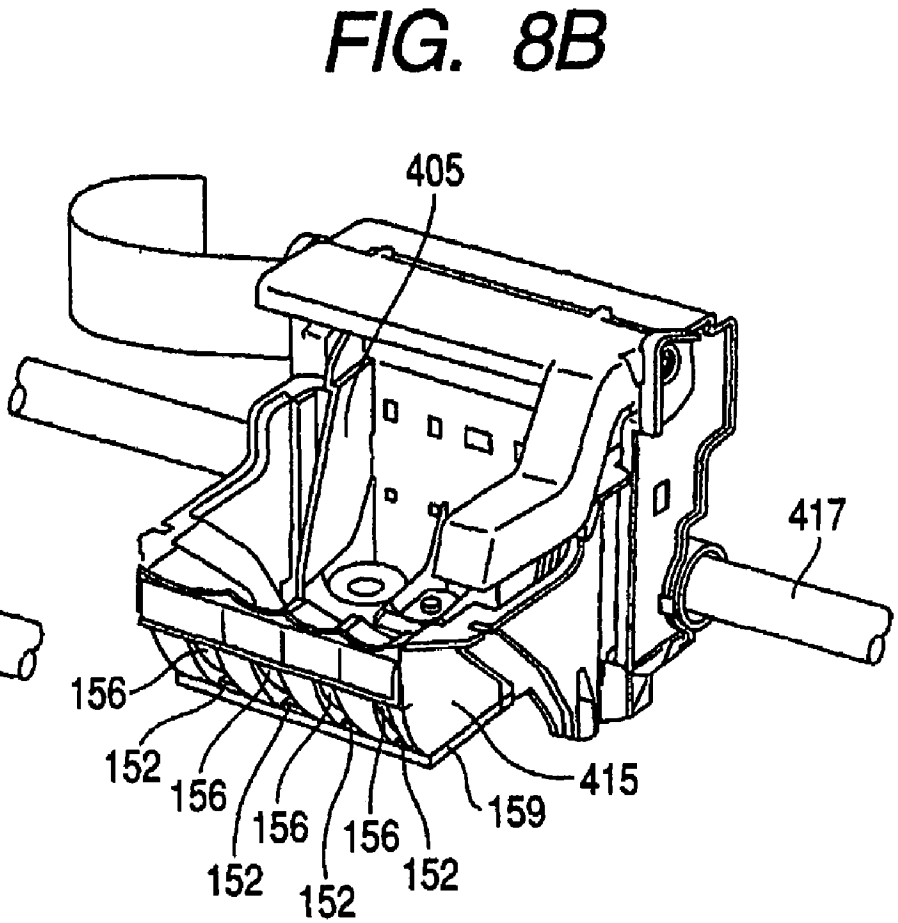
FIGS. 8A and 8B are perspective views showing another example of the structure of the installation portion of the ink tank in which the invention can be employed.
Figure 8A:
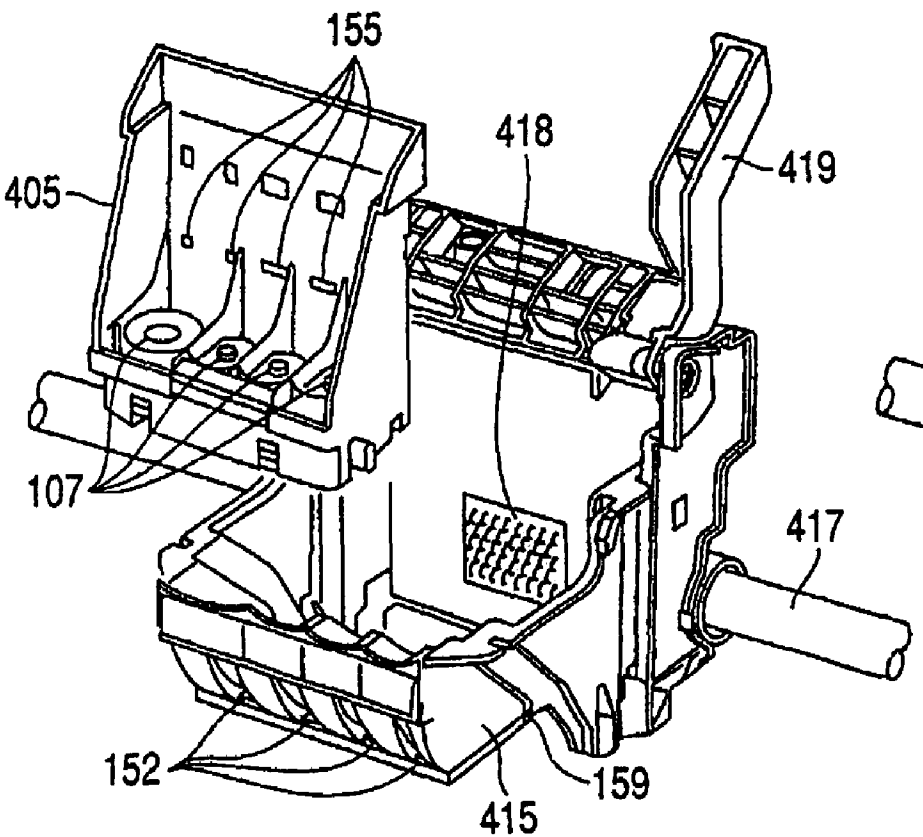

The carriage 415 movable along the shaft 417, as shown in FIG. 8B, is provided with the lever 419 for mounting and fixing the recording head unit 405 and the electrically connecting portion 418 connected with an electrically connecting portion at the recording head side. Furthermore, there is the holder portion corresponding to the structure of the front face side of the ink tank. That is, the second looking portion 156, the connector 152 and the wiring 159 to the connector are arranged at the carriage side.

According to this structure, the entire structure of the installation portion of the ink tank can be seen in the condition where the recording head unit 405 is being mounted in the carriage 415 as shown in FIG. 8B. That is, after following the similar mounting process of FIGS. 7A to 7C, the mounting process is completed as connecting the ink supply port 7 and the ink inlet 107 and connecting the pad 102 and the connector 152.

Figure 9:
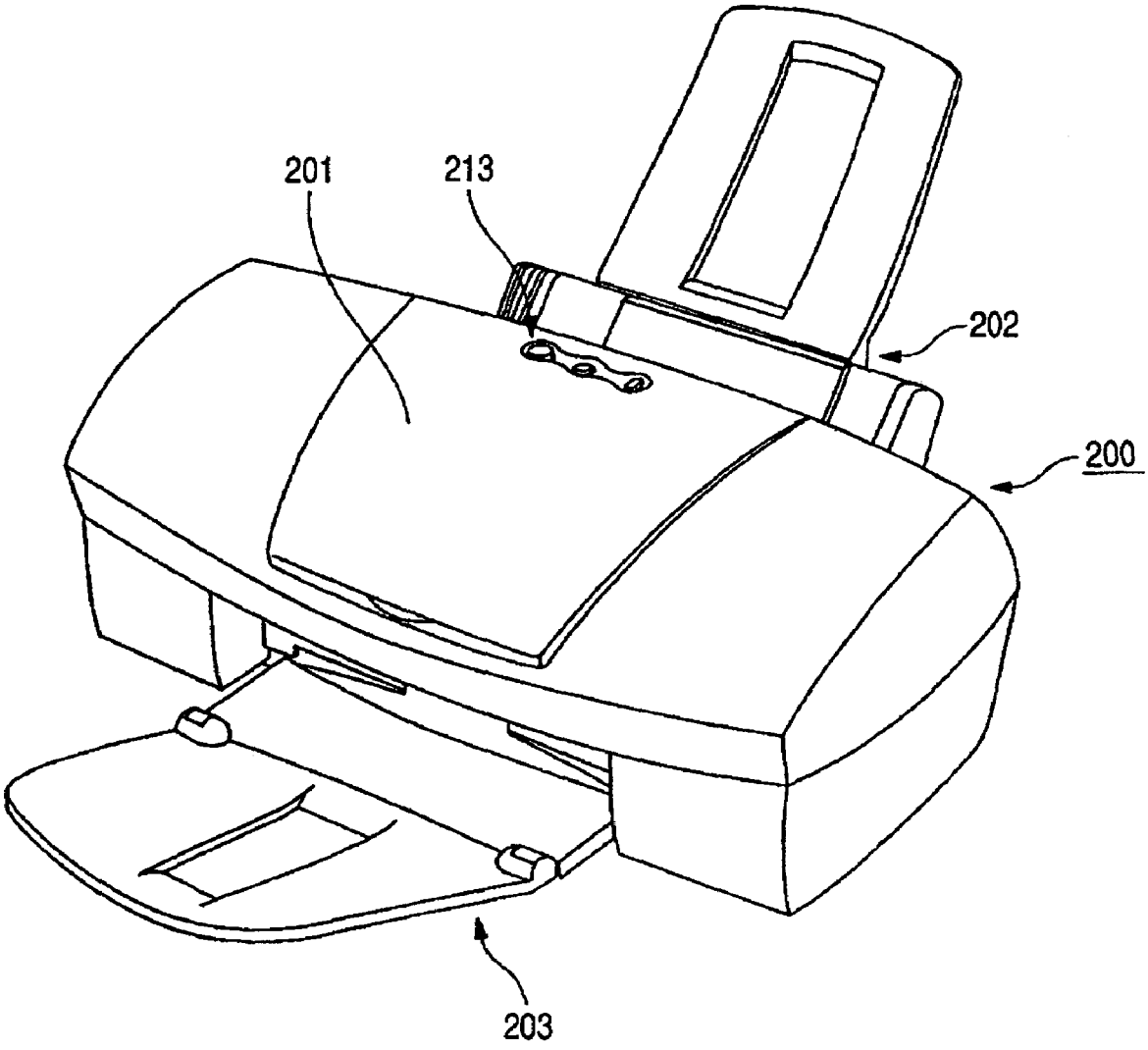
FIG. 9 is a view of appearance of the ink jet printer recording as mounting the ink tank in which the invention can be employed.
Figure 10:
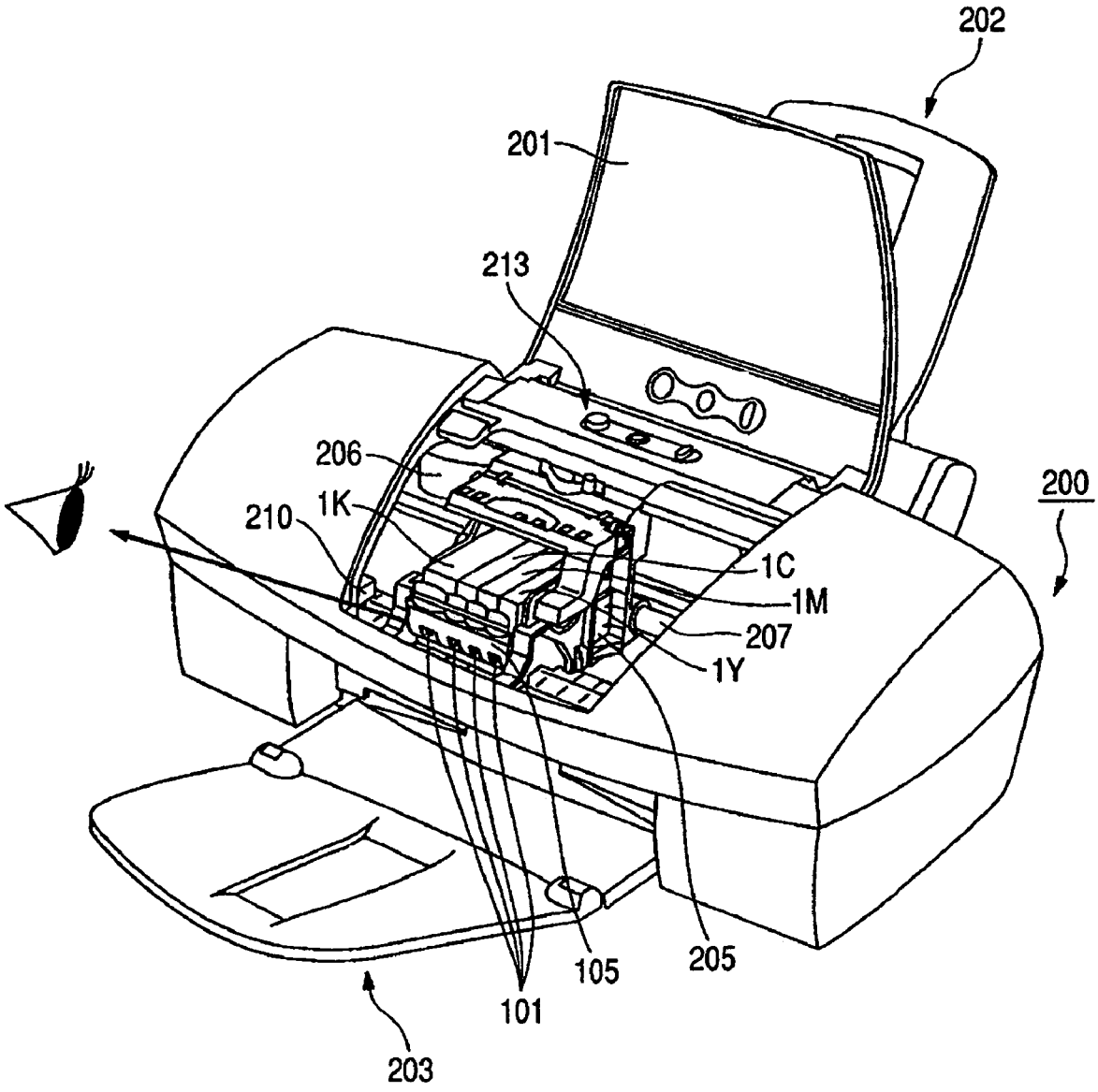
FIG. 10 is a perspective view of the ink jet printer of FIG. 9 with a body cover 201 opened.

Recording Apparatus (FIG. 9 and FIG. 10)

FIG. 9 is the view showing the appearance of the ink jet printer 200 which records by mounting the ink tank as explained above. FIG. 10 is the perspective view of the ink jet printer 200 of FIG. 9 with the main body cover 201 opened.

As shown in FIG. 9, in the printer 200 according to this embodiment, the main part thereof where the carriage to which the recording head and the ink tank are mounted moves for scanning is covered by the body cover 201. This embodiment further comprises a sheet ejecting trays 203 provided in front of and behind the carriage and an automatic sheet feeder (ASF) 202. This embodiment still further comprises the display device showing the condition of the printer body both when the main body cover is being opened or closed and an operation portion 213 with a power supply switch and a reset switch.

FIG. 10 shows the view of opened body cover 201. The user can view the moving/scanning range and its surrounding of the carriage on which the recording head unit 105 and the ink tanks 1K, 1Y, 1M, and 1C (hereinafter occasionally these ink tanks are simply referred to the reference numeral "1") are mounted. Practically, when the body cover 201 is opened, a sequence of the carriage 205 automatically moving to a substantially central region in FIG. 10 (hereinafter tank replacement position) is performed, and the user may replace the respective ink tanks at the tank replacement position.

In the printer according to this embodiment, the recording head unit 105 has recording heads with chips corresponding to the respective inks (not shown in the figures). The respective color recording head scans the recording medium such as a sheet as moving the carriage 205, and the ink is discharged on the recording medium during the scanning period so as to perform recording. That is, the carriage 205 slidably engages with a guide axle 207 extending in the moving direction thereof and moves by a carriage motor and a driving force transmission mechanism. Each recording head corresponding to the inks K, Y, M, and C discharges the ink based on the discharging data transferred from the control circuit at the main body side via a flexible cable 206. A sheet feeding mechanism of sheet transferring rolls and sheet feeding rolls exists, thereby transferring the recording medium (not shown in the figures) fed from the automatic sheet feeder 202 to the sheet ejecting tray 203. Also, the recording head unit 105 integrated with the ink holder is mountably/removably mounted on the carriage 205 while the respective ink tanks 1 in a cartridge shape is mountably/removably mounted relative to the recording head unit 105. That is, the recording head unit 105 may be mounted on the carriage 205; the ink tank 1 may be mounted on the recording head unit 105; and the ink tank 1 is mountable/removable relative to the carriage 205 via the recording head unit 105 in this embodiment. One embodiment of the liquid supply system of the invention is structured by mounting the ink tank 1 on the recording head unit 105.

In the recording operation, while the recording head moves as explained above to scan, the respective recording heads discharges the inks onto the recording medium, thereby recording the area of the range corresponding to the discharging port of the recording head. Furthermore, during the time between the scanning and the next scanning, the above explained sheet transferring mechanism transfers the predetermined length of sheet corresponding to the above range so as to record on the recording medium in order. A discharge recovery unit, such as a cap covering the surface on which the discharging port is disposed at the respective recording heads, is provided around an end of the moving range of the recording head due to the movement of the carriage. Accordingly, the recording head moves to the position where the discharge recovery unit is located with predetermined time intervals, thereby recovering such as preliminary discharge.

The connector corresponding to the respective ink tanks, as explained above, is provided at recording head unit 105 having the holder portion of the respective ink tanks 1, and the respective connectors contacts with the pad of the substrate provided to the ink tank 1. Accordingly, the respective LEDs 101 may be controlled to light or flash according to the sequence, which will be shown later with reference to FIG. 17 to FIG. 23D.

Concretely, at the above tank replacement position, when the amount of the residual ink in any ink tank 1 becomes little, the LED 101 of the subject ink tank 1 lights or flashes. Within the moving range of the carriage, the first photoreceptor portion 210 having the photoreceptor element is formed adjacent to the end at the opposite side of the position where the above recovery unit is provided. Accordingly, along with the movement of the carriage 205, the LED 101 of the respective ink tanks 1, when passing the photoreceptor portion 210, makes the LED 101 to emit the light. Based on the position of the carriage 205 when intercepting that light, the position of the respective ink tanks 1 on the carriage 205 may be detected. Furthermore, as another example of controlling such as LED lighting, at the above explained tank replacement position, when the ink tank 1 is properly mounted, the LED 101 of the tank is controlled to be lighted. This control, similar to the control of such as the ink discharge of the recording head, is performed by transferring the control data (control signal) relative to the respective ink tanks from the control circuit at the main body side via the flexible cable 206.

Structure of the Control System

Figure 11:
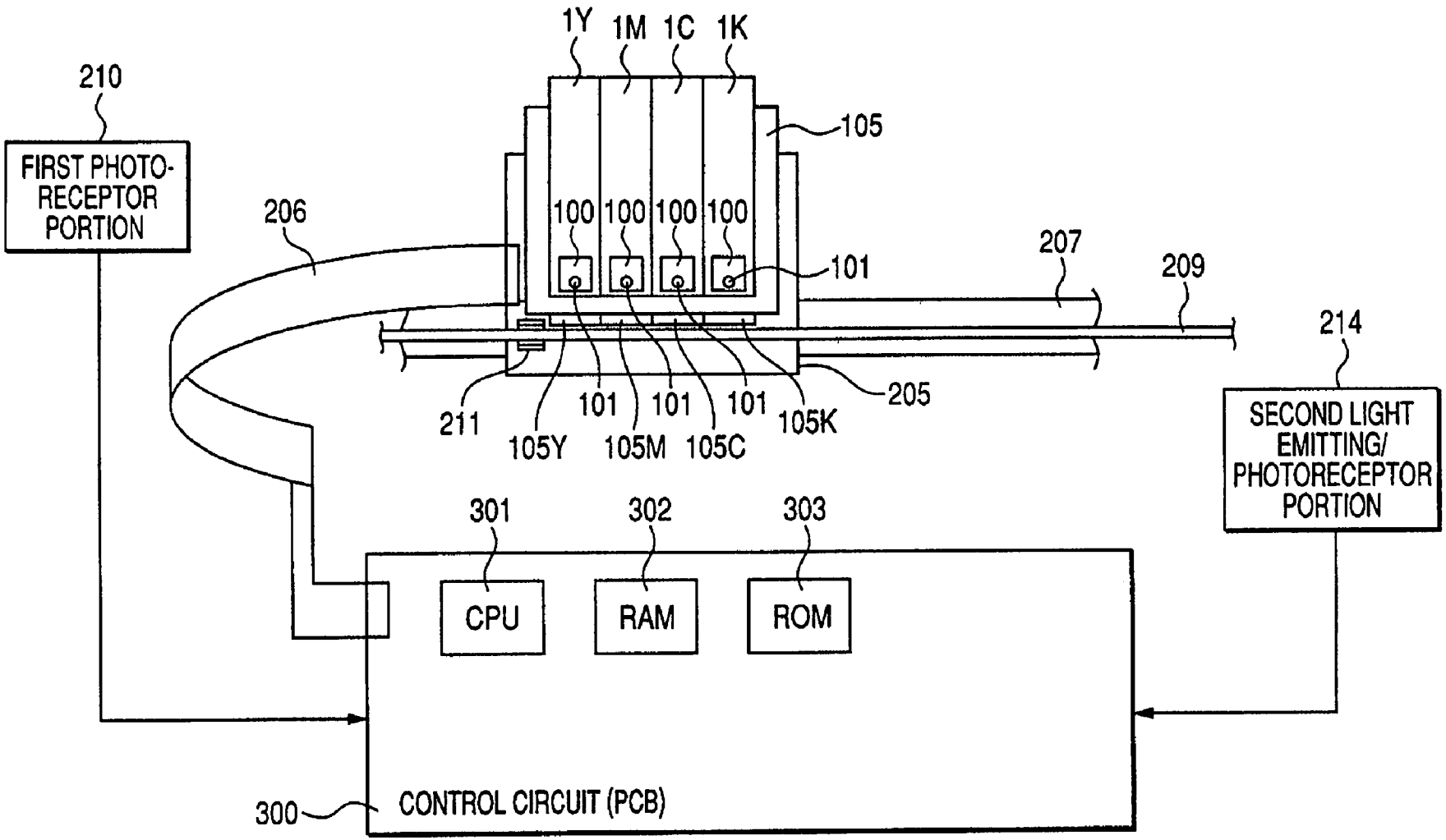
FIG. 11 is a block diagram showing the control structure of the above ink jet printer.

Entire Structure (FIG. 11)

FIG. 11 is a block diagram showing the structural example of the ink jet printer control. FIG. 11 shows the structure regarding the control circuit of PCB (printed circuit board) type in the printer body and emission of the first light emitting portion (hereinafter may be referred to as an LED) controlled by the control circuit.

In FIG. 11, the control circuit 300 performs data processing and operation control regarding this printer. Concretely, a CPU 301 performs the later explained process in FIG. 17 to FIG. 20 and FIG. 24 following the program stored in a ROM 303. An RAM 302, when processing by the CPU 301 is executed, may be used as a work area.

In FIG. 11, the recording head unit 105 is comprised of the recording heads 105K, 105Y, 105M, and 105C with plural discharging ports to discharge black (K), yellow (Y), magenta (M), and cyan (C). Then, the ink tanks 1K, 1Y, 1M, and 1C corresponding to the recording heads are mountably/removably mounted relative to the holder of the recording head unit 105. There is no limit on colors and the number of the ink tanks, and similar color and colors with different density may be employed.

As explained above, the substrate 100 with such as the LED 101, the LED display control circuit, and the pad functioning as the contacting terminal is installed on each ink tank 1. Then, when the ink tank 1 is properly mounted on the recording head unit 105, the pad on the above explained substrate 100 contacts the connector, each is provided as corresponding to the ink tank 1 in the recording head unit 105. The connector (not shown in the figures) provided on the carriage 205 makes a signal connection with the control circuit 300 at the main body side via the flexible cable 206. Furthermore, as the recording head unit 105 is mounted on the carriage 205, the connector of the carriage 205 makes the signal connection with the connector of the recording head unit 105. According to the above connection structure, the signal can be given and received between the control circuit 300 at the main body side and each ink tank 1. As such, the control circuit 300 is able to control the lighting and flashing according to the later explained sequence in FIG. 17 to FIG. 23D.

The control of the ink discharge relative to the recording heads 105K, 105Y, 105M, and 105C is same as above. That is, the driving circuit provided at each recording head makes the signal connection with the control circuit 300 at the main body side via the flexible cable 206, the connector of the carriage 205, and the connector of the recording head unit. Accordingly, the control circuit 300 is able to control the ink discharge at the respective recording heads.

The first photoreceptor portion 210 adjacent to one end of the moving range of the carriage 205 intercepts the light from the LED 101 of the ink tank 1 and outputs the signals in accordance with the light to the control circuit 300. The control circuit 300 as explained later can determine the position of the respective carriages 205 of the ink tank 1 based on the signal. The encoder scale 209 is provided along a moving path of the carriage 205, and the encoder sensor 211 is positioned on the carriage 205. This detected signal of the encoder sensor 211 is input in the control circuit 300 via the flexible cable 206, thereby recognizing the moving position of the carriage 205. This position information is used to control the discharge of the recording head and for the light matching process to detect the ink position as explained later with FIG. 17 or the like. Furthermore, the second light emitting and/or photoreceptor portion 214 adjacent to a predetermined position in the moving range of the carriage 205 has a light emitting element and a photoreceptor element and outputs signals relating to the amount of the residual ink in the respective ink tanks 1 mounted on the carriage 205 to the control circuit 300. Then, the control circuit 300 detects the amount of the residual ink based on the signals.

Figure 12:
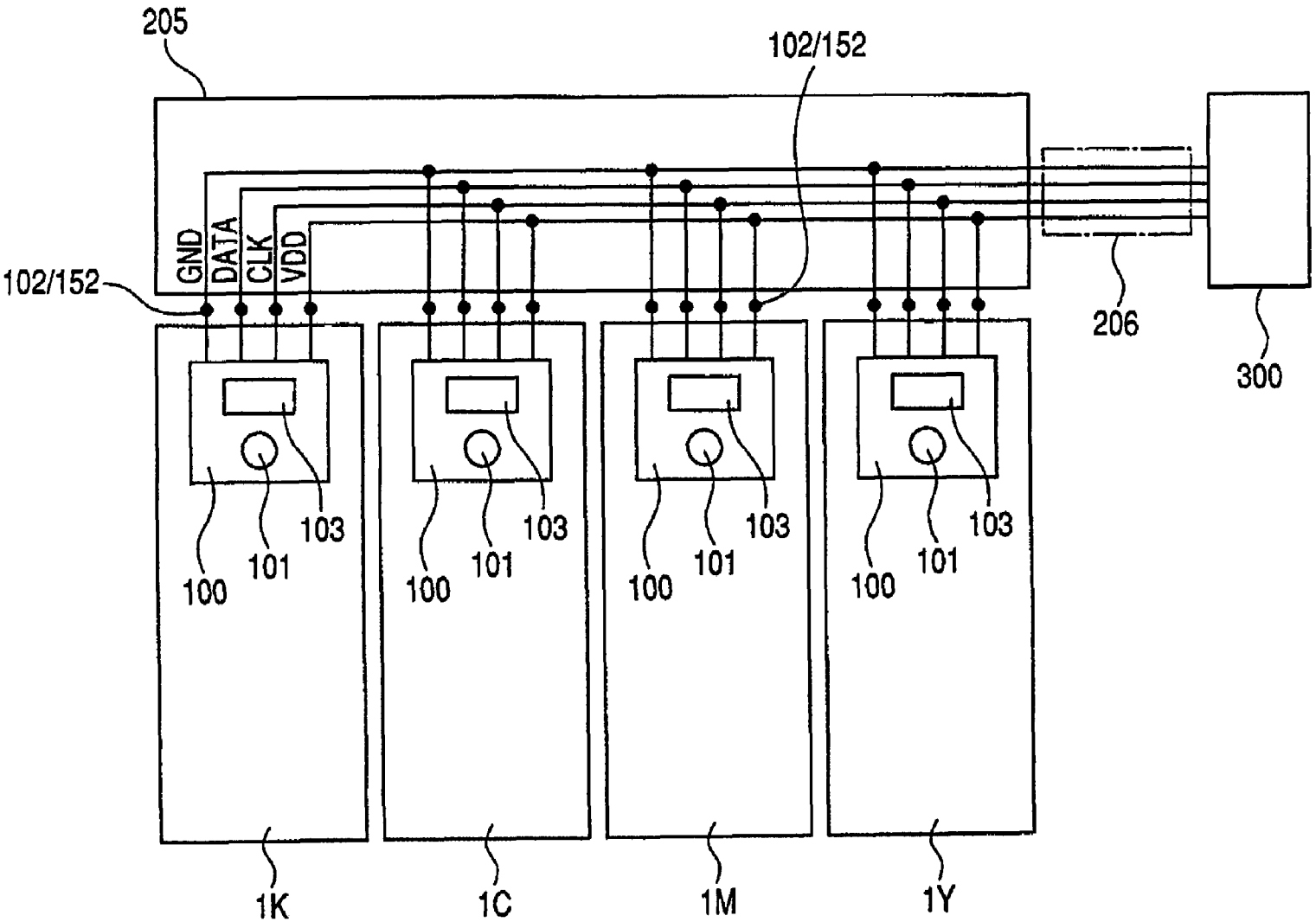
FIG. 12 is a view showing a relation between signal wiring structure for signal connection by a flexible cable of the ink jet printer with the ink tank and the substrate of the respective ink tanks.

Structure of Connecting Portion (FIG. 12)

FIG. 12 is a view showing signal wiring structure for the signal connection between the flexible cable 206 and the ink tank 1 in relation to the substrate 100 of the respective ink tanks.

As shown in FIG. 12, the signal wiring to the ink tank 1 comprises four signal wires and signal wires common to four ink tanks 1 (bus connection). That is, the signal wire relative to the respective ink tanks 1 is comprised of a power signal wire (VDD), and a ground signal wire (GND) relating to the power supply such as an operation of the control unit 103 performing light emitting of the first light emitting portion (LED 101) in the ink tank and the driving control thereof. Further, as explained later, the signal wire is comprised of four wires, namely, a signal line (DATA) and its clock signal wire (CLK) for transmitting such as control signals (control data) relating to the processing such as a lighting and flashing LED 101 from the control circuit 300. An explanation as to four wires will be made in this embodiment; however, wiring is not limited to this degree and for example GND may be omitted as employing different ground signal structure. Also, signal wires of CLK and DATA may be combined into 1 wire.

On the other hand, the substrates 100 of the respective ink tanks 1K, 1Y, 1M, and 1C have the control unit 103 operated by signals of the four signal wires for the ink tanks and the LED 101 as a light emitting portion controlled its operation thereby. The above is one example of the structures with the minimum electric terminal relative to ink tank, and the control of the LED 101 and acquisition/renewal of the ink tank information may be performed based on driving timing charts shown in FIG. 15 and FIG. 16.

Figure 13:
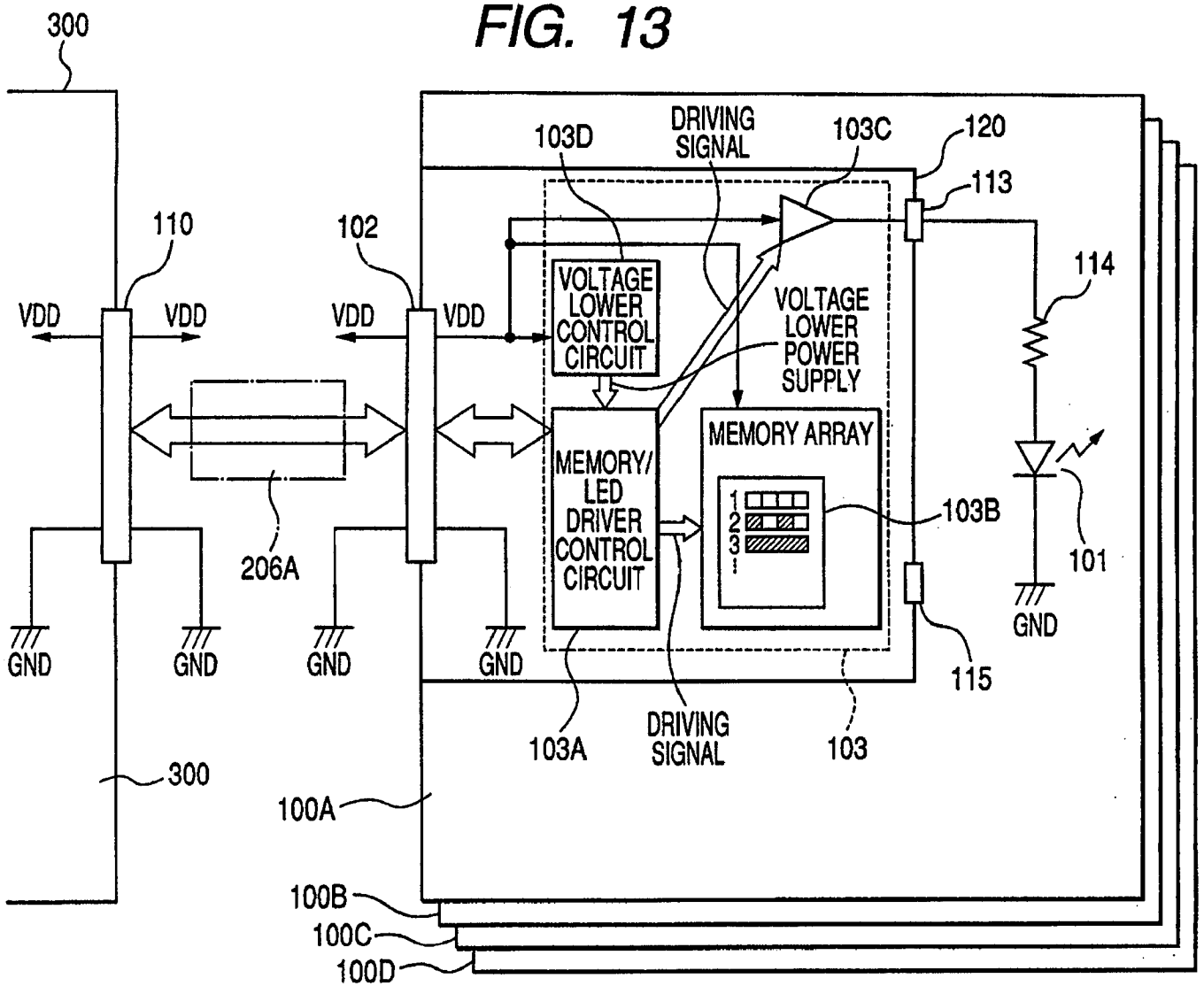
FIG. 13 is a circuit view showing the details of the above substrate on which the controlling portion is mounted according to the main part of one embodiment of the invention.
Figure 14:
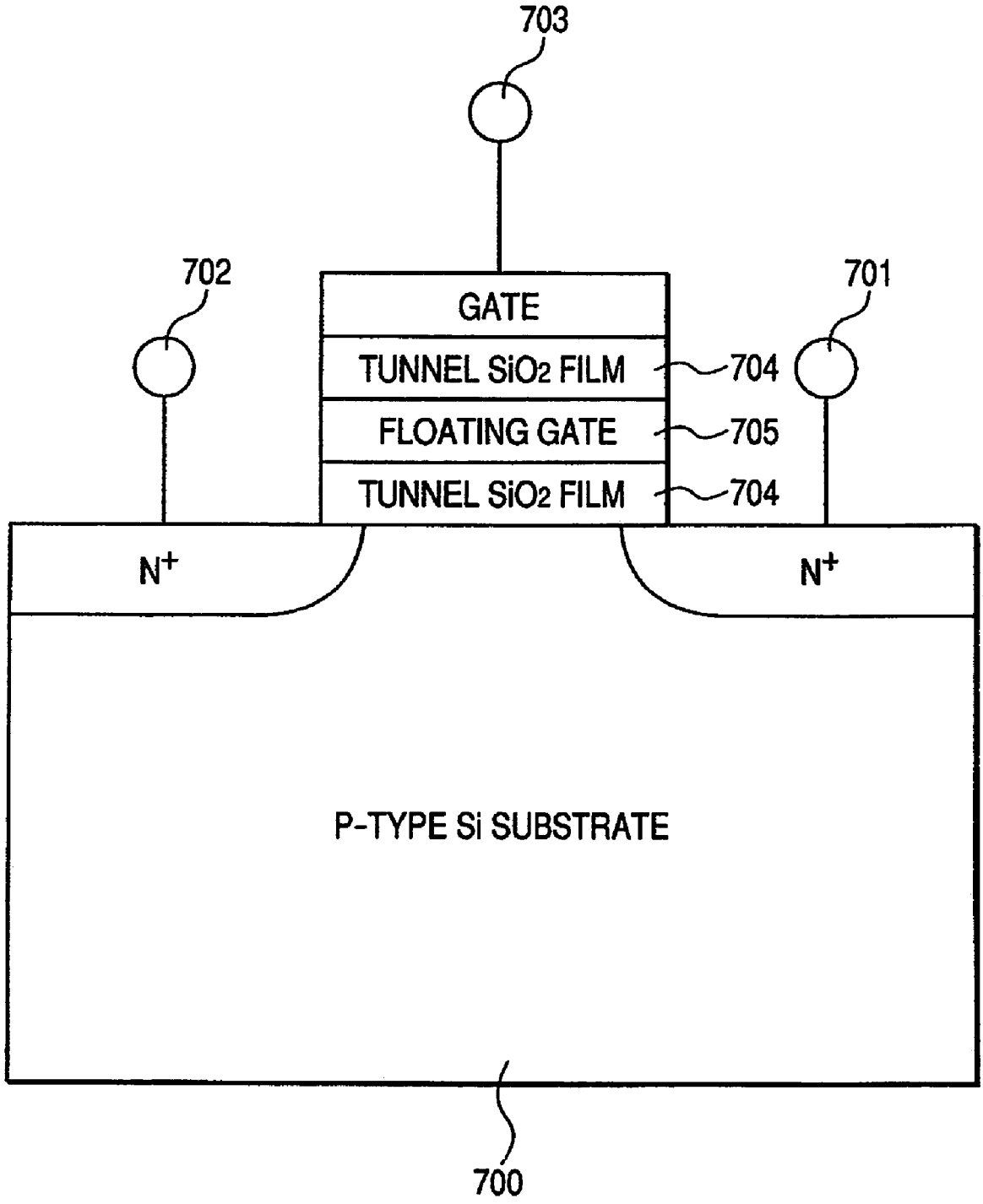
FIG. 14 is a circuit view showing a modification of the substrate structure shown in FIG. 13.

Structure of Controlling Portion (FIG. 13 and FIG. 14)

FIG. 13 is a circuit view showing the details of one embodiment of the substrate having such as the controlling portion in which the invention can be employed. In this embodiment, the cartridge is explained as the ink tank; the recording agent is explained as the ink; and the light emitting portion is explained as light emission diode (LED). As shown in FIG. 13, the control unit 103 on the substrates 100A to 100D of the ink tank comprises a memory array 103B (namely, information retention portion) and a LED driver 103C (namely, driving portion). Furthermore, there are a memory/LED driver control circuit 103A (namely, controlling portion) which controls the memory array 103B and an LED driver 103C and a voltage lower control circuit 103D supplying power supply voltage VDD to the memory/LED driver control circuit 103A by lowering the voltage thereof. This structure is implemented in the semiconductor board 120. The memory/LED driver control circuit 103A displays the LED 101 via the LED driver 103C conducting the informing operation according to the control data transmitted via the flexible cable 206 from the control circuit 300 at the main body side. The memory/LED driver control circuit 103A controls write/read of the data relative to the memory array 103B. FIG. 13 is a block diagram, and therefore the signal connection between the control circuit 300 at the main body side and the substrate 100A at the ink tank side is simplified therein. However, in reality, the control data transmitted from the control signal connector 110 at the main body side via the flexible cable 206 is not transmitted directly to the substrates 100A to 100D on the ink tank. That is, the control data is transmitted via such as the electric contact point for the signal transmission provided at the carriage and the electric contact point 157 at the recording head unit side. Also, in FIG. 13, the reference numeral 206A is assigned to the signal wire relating to the above DATA and CLK.

A terminal 113 connects the LED 101 at an anode side with the LED driver 103C of the semiconductor board 120. A limit resistor 114 determines the electric current flowing in the LED 101 and is positioned between the output of the LED driver 103C and the anode of the LED 101. Here, the limit resistor 114 may be implemented in the substrates 100A to 100D on the ink tank as shown in the figure or integrated in the semiconductor substrate 120.

The memory array 103B is EEPROM type in this embodiment and is able to record the amount of the residual ink, the color information of the ink to be contained, manufacturing information such as serial number of the ink tank and a rod number and so on. Here, the memory array 103B as the information storing portion may be of another nonvolatile memory such as for example a flash memory and a ferroelectric RAM.

Figure 15:
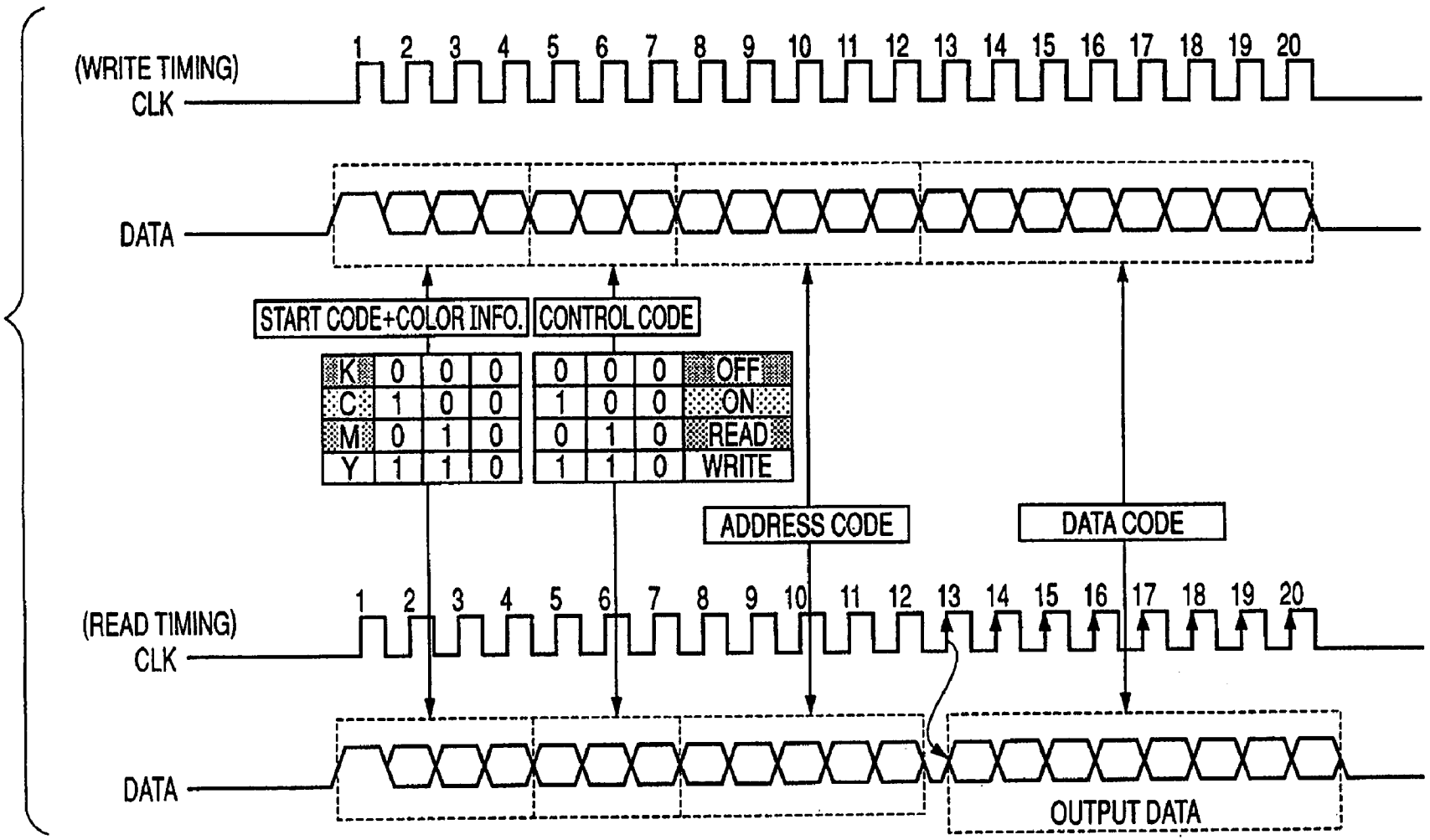
FIG. 15 is a timing chart explaining actions of data write/read relative to the memory array of the above substrate.
Figure 16:
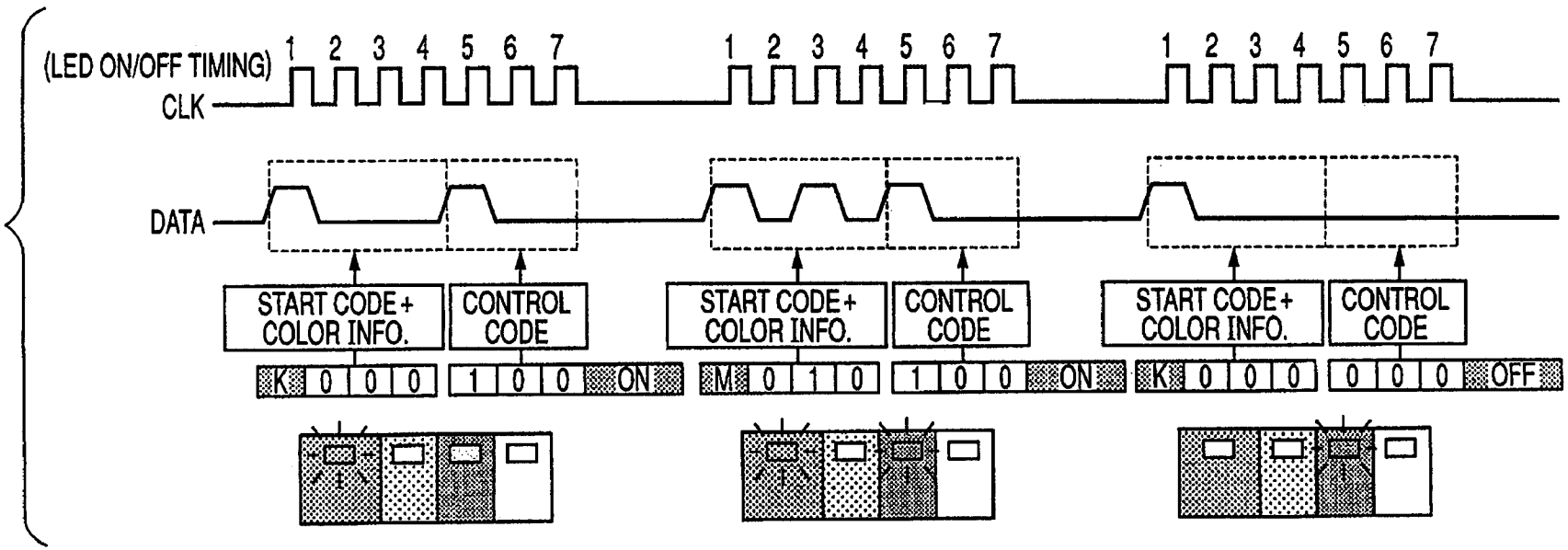
FIG. 16 is a timing chart explaining actions of lighting and light out of the LED 101.

The color information stored in the memory array 103B, when shipping or manufacturing the ink tank, is written in the predetermined address of the memory array 103B corresponding to the ink color. This color information, as later explained in FIG. 15 and FIG. 16, is used as the identification information regarding the ink tank. The ink tank is specified to write in the data relative to the memory array 103B and to read the data from the memory array 103B, and the LED 101 of the ink tank is controlled to be lighted and flashed.

The data to be written in and read from the memory array 103B, in addition to the above-explained information, may be for example the data of the amount of the residual ink. In the ink tank of this embodiment, as explained above, the prism shaped detecting element 17 is provided at the bottom thereof, and the information of the ink condition indicating that the amount of the residual ink became little is optically detected via the detecting element 17. In this embodiment, in addition to the above, the control circuit 300 counts the number of discharge per recording head based on the discharging data and determines the amount of the residual ink per ink tank based on that information. Then, the information of the residual ink is written in or reading from the corresponding memory array 103B of the ink tank. Accordingly, the memory array 103B retains the information of the amount of the residual ink at that particular time. This information is used for example in performing highly accurate detection of the amount of the residual ink in combination of the detection of the amount of the residual ink using the above prism detecting element 17. This information is also used for the determination as to whether the mounted ink tank is new or a remounted ink tank which was used before.

Various information can be written in and read from the memory array 103B and such a memory access requires relatively high voltage. FIG. 14 explains about this situation. Here, the explanation relates to when EEPROM is used as the memory array 103B; however, other type of memory requires high voltage as well.

A basic structure of EEPROM is called FLOTOX (FLOating gate Tunnel OXide). FLOTOX cell is comprised of a select transistor of a stacked gate type memory central transistor and a gate 703, a tunnel $SiO_2$ film 704, and a floating gate 705 connected in series thereto.

Tunnel effect (phenomenon of electron passing through a film as high electric field is applied to an insulator thin film) is utilized for writing in the EEPROM, and high voltage is necessary in order to generate the tunnel effect. When high voltage is applied to the outside gate 703, a strong electric field is applied between P type silicon substrate 700 and the floating gate 705. Then, the electron in the channel flows and passes through the thin tunnel $SiO_2$ film 704 contacting with the channel due to the tunnel effect because of a positive voltage of the gate 703, and is charged to the floating gate 705. A threshold voltage of MOS transistor changes depending upon the amount of the electric charge of electrified floating gate 705. Here, if the number of electrons in the floating gate 705 is higher, the channel cannot be formed unless the gate 703 applies the positive voltage. That is, "1" and "0" can be distinguished by the difference in the threshold voltage, which can be used as the data. Because the electric charge of the floating gate 705 does not have a path to leak, it remains in the floating gate 705 even if the power is turned off, thereby functioning as a nonvolatile memory.

The LED driver 103C operates to apply the power supply voltage VDD to the LED 101 when the driving signal output from the memory/LED driver control circuit 103A is on, thereby emitting the light from the LED 101. Accordingly, when the signals output from the memory/LED driver control circuit 103A is on, the LED 101 maintains the light-on condition while maintaining light-off condition when the signal is off.

As such, relatively high power is necessary for accessing the memory array 103B and lighting the LED 101, which however is not necessarily conducted all the time. Actions such as the memory array access and LED lighting occur at appropriate timings. The memory/LED driver control circuit 103 is cable of performing distributed drive relative to plural substrates 100A to 100D on the same bus. As such, including an order applicable to the ink tanks of other colors, all orders sent in common signal wires (bus) are constantly loaded to see whether the order is for the subject ink tank. If the order is to the subject ink tank, the job is implemented while the order is to other color, then the order is ignored. Accordingly, the memory/LED driver control circuit 103A according to this embodiment constantly operates but the voltage during the operation does not need to be high comparing to the memory array 103B and LED 101.

Also, improvement of CMOS semiconductor process is significant and as the semiconductor process improves, the width of the wire comprising the circuit structure becomes narrower and the chip area becomes smaller. Then, an area of MOS (Metal Oxide Semiconductor) type FET (Field Effect Transistor) constituting a logic circuit becomes smaller. Accordingly, low voltage operation and low power consumption can be realized. That is, the power consumption of the circuit constituting the memory/LED driver control circuit 103A is decreased following the improvement of the semiconductor process. However, because the operation principle of the memory array 103B, as explained above, does not directly relate to the wire width of the semiconductor process, improvement of the semiconductor process does not affect on the decrease in the operating voltage and power consumption.

In consideration of the above explanation, in this embodiment, appropriate power supply voltage VDD is supplied to access the memory array 103B and to drive the LED 101. For the memory/LED driver control circuit 103A that may be operated with lower voltage, the voltage lower control circuit 103D lowers the power supply voltage to be supplied thereto. Accordingly, by employing the bus connecting structure to supply the power with a single line, appropriate power of the voltage may be supplied to the plural elements with different driving voltage (the memory/LED driver control circuit 103A and the memory array 103B, the LED 101). The memory/LED driver control circuit 103A, which is a constantly driving control part, can be driven with low voltage. Furthermore, the memory/LED driver control circuit 103A accesses the memory array 103B and drives the LED 101 with appropriate timing, thereby realizing the power saving.

Although not in an identical technical field in which the invention resides, the technology with power saving effect regarding the electronic control module is disclosed in the Japanese Patent Application Laid-Open Nos. H05-266224 and 2002-7374.

Japanese Patent Application Laid-Open No. H05-266224 discloses the technology which has plural function modules within a semiconductor integrated circuit and the voltage lower control circuit which lowers the power supply voltage to be supplied from outside to each module. Accordingly, the disclosed structure is such that the power wire within the semiconductor integrated circuit can equally be shorter and the voltage effect generated at the wire can be decreased.

Japanese Patent Application Laid-Open No. 2002-7374 is planed to provide a power saving 1 chip microcomputer built in the flash memory. That technology comprises the nonvolatile memory storing the program implemented by the CPU, volatile memory temporarily storing a part of the program therein, and the voltage lower control circuit which lowers the line power from outside to the predetermined level. Furthermore, this patent discloses the structure that comprises the power saving control circuit controlling the output voltage and transfer the part of the program of the nonvolatile memory to the volatile memory as necessary to be used by the CPU. Accordingly, the number of access to the nonvolatile memory requiring the higher voltage is reduced, and the power saving is achieved as using the nonvolatile memory which can be dealt with the lower voltage.

These Japanese Patent Application Laid-Open Nos. H05-266224 and 2002-7374 are aimed to achieve power saving effect in a single circuit and are not aimed to achieve power saving effect for the entire recording apparatus as this embodiment. Also, these two inventions does not show that the emission control of the display device of the LED 101 is implemented as necessary by using the common signal wire relative to the mounting position of the respective ink tanks on which the respective substrates is provided and that access to the memory array 103B is properly controlled as necessary. That is, relative to an event necessary at the series of controlling process at the recording apparatus, the control means (memory/LED driver control circuit 103A), which properly selects and operates the memory array 103B and the LED 101, is disposed. Accordingly, no indication of the structure for the power saving effect of the recording apparatus can be seen.

According to this embodiment, appropriate voltage can be supplied to each of plural elements with different operating voltage as well as lower voltage can be supplied to the memory/LED driver control circuit 103A as a controlling portion so as to realize continuous operation. Furthermore, as such, accessing the memory array 103B and driving the LED 101 can be performed at appropriate timings, thereby realizing the power saving effect.

Operation of Controlling Portion (FIG. 15 and FIG. 16)

FIG. 15 is the timing chart explaining each operation of write/read of the data relative to the memory array of the above substrate 103; and FIG. 16 is the timing chart explaining each operation of lighting and light-out of the LED 101.

As shown in FIG. 15, when writing in the memory array 103B, writing operation is performed by the control circuit 300 of the main body side into the memory/LED driver control circuit 103A at the controlling portion 103 of the ink tank 1. That is, each data signal of "Start Code+Color Information", "Control Code", "Address Code", and "Data Code" is sent in this order as synchronizing in the clock signal CLK.

"Start Code+Color Information" means that a series of data signal starts by the "Start code", and that a target ink tank for a series of data signal is specified by "Color information", which can be added commonly when accessing (writing/reading) the memory array 103B as well as controlling to light-on/light-off the LED 101.

"Color Information", as shown in the figure, has matching codes relative to the ink colors, "K", "C", "M", "Y", and the memory/LED driver control circuit 103A compares the color information shown by these codes with own color information stored in the memory array 103B. As a result, only if the codes match, the following data code loading process is processed and if the codes do not match, the following data code loading process is stopped. In this embodiment, "Color Information" corresponds to "Individual Information from Recording Apparatus". Because of this, the ink tank can be specified even if the data signal is sent from the main body side to the respective ink tanks via the common signal wire "DATA" shown in FIG. 12 by including the above color information. Furthermore, the process thereafter based on the data signal such as writing, reading, and lighting-on and lighting-off of the LED can be processed only regarding the specified ink tank. As a result, relative to four ink tanks, writing of the date and light-on and light-off of the LED may be controlled by the data transmitted via one common data signal wire, thereby reducing the number of signal wires necessary for this controlling process. Also, it is obvious from the above explanation that this structure of using one common data signal wire is not limited to the particular number of ink tank. The number of wires may be the same as that of ink tank.

In the writing operation relative to the memory array 103B, "WRITE" code, which is a control code following the "Color Information", issues a write operation order, and the next address code specifies the address of the memory array 103B to be written therein. The data with contents expressed by the last data code synchronizes with an initial clock build up (at 13 clocks in FIG. 15) after the end of the address code to be written in the subject address.

Data signal structure of read-out is same as the above explained write-in, and the code of "Start Code+Color Information" is loaded, just like the above explained write-in process by the memory/LED driver control circuits 103A of all ink tanks. Also, the data signal thereafter can be loaded only by the memory/LED driver control circuit 103A with identical "Color Information". Difference is that the data is read-out or output as synchronizing at the build up of the first clock (at 13 clocks in FIG. 15) after the address code upon specifying the address by the address code. Even if plural ink tank data signal terminals are connected to such one common data signal wire, the memory/LED driver control circuit 103A arranges so that the read-out data does not collide against outer input signals.

Certainly, contents expressing "Control Code" for memory access are not limited to the above explained example, and for example control codes such as a verify command and continuous read-out command can be used.

Next, as shown in FIG. 16, lighting on or lighting off of the LED 101, as in the above explanation, first, the date signal of "Start Code+Color Information" is sent to the memory/LED driver control circuit 103A via the signal wire DATA from the main body side. As explained above, the ink tank is specified by "color information", and lighting-on/lighting-off control of the LED 101 specified based on "Control Code" is executed only at the specified ink tank. "Control Code" relating to lighting on/lighting off, as shown in FIG. 15, can be "ON" or "OFF" where "ON" turns the LED 101 on and "OFF" turns the LED 101 off. That is, when the control code is "ON", the memory/LED driver control circuit 103A, as shown in FIG. 13, outputs the "ON" signal relative to the LED driver 103C and maintains the output condition thereafter. On the contrary, when the control code is "OFF", the memory/LED driver control circuit 103A outputs the "OFF" signal relative to the LED driver 103C and maintains the output condition thereafter. Here, actual timing of lighting or lighting-off of the LED 101 is such that the lighting or lighting-off is performed at the first clock after the control code (eighth clock in FIG. 15), at every data shown in FIG. 16.

In the example shown in FIG. 16, the ink tank of the black K is specified as in the most left end data signal in FIG. 16, and the LED 101 of the ink K tank is lighted. Next, "Color Information" of the second data signal designates the magenta ink M, and "Control Code" orders to light on, and therefore the LED 101 of the ink M tank is lighted while the LED 101 of the ink K tank is being lighted. Then, because the third data signal indicates that "Control Code" for the ink K tank orders light off, the LED 101 only for the ink K tank is turned off.

As understood from the above explanation, the LED can be controlled to flash by the control circuit 300 at the main body side transmitting the data signals, each containing "Control Code" of light-on/light-off, as specifying the ink tank. At that time, fixing the cycle of transmitting the signals allows to control a flashing cycle. As explained above, recent printers tend to increase the number of inks utilized therein. However, to the users, regardless of the number of ink tanks, namely, for the printer using relatively large number of the ink tanks (for example, four colors) as well as for the printer using relatively small number of the ink tanks (for example, two colors), providing the same display avoids the user's confusion and is preferable. As such, even if the number of controlling portions 103 to be controlled at once by one signal wire increases due to the increase of the ink tanks, in order to realize the flashing with the same intervals, it is strongly suggested that the flashing cycle, namely, the timing defining light-on/light-off, be shortened.

In this embodiment, as obvious from the above explanation, the format of the access command relative to the memory array 103B and the format of the command used for LED light-on/light-off are individually prepared. For the command used for controlling of light-on/light-off, "Address Code" and "Data Code" necessary for the control code relative to the memory array 103B may be omitted so that the command length used for the LED light/light-off can be shorter. As such, the command used for light-on/light-off can be supplied with a shorter cycle and therefore the flashing is possible even if the number of the ink tank is large.

"Control Code" and operation of the inner circuit corresponding to the "Control Code" preferable to implement the characteristic control of this embodiment will be explained next.

"Control Code" according to this embodiment, as shown in FIG. 15, has "READ" and "WRITE" codes, suggesting to access, namely, read out/write in, the memory array 103B. Furthermore, "Control Code" also has "ON" and "OFF" codes, each light-on/light-off the LED. That is, the contents of the control code accessing the memory array 103B is defined and clearly distinguished from the contents of the control code used for the LED light-on/light-off.

The controlling portion 103 according to this embodiment may have a mode executing an access order relative to the memory array 103B (hereinafter "memory access-exclusive mode") only and a mode executing an LED light-on/light-off control order (hereinafter display exclusive mode). Then, under the circuit structure as shown in FIG. 13, the memory/LED driver control circuit 103A does not supply power to the LED driver 103C in the "memory access exclusive mode". To the contrary, in the display exclusive mode, the memory/LED driver control circuit 103A does not supply clock to the memory array 103B. As a result, in the "display exclusive mode", the access to the memory array 103B is prohibited, and the LED 101 lights off in the "memory access exclusive mode".

Accordingly, when the user replaces the ink tank (when the carriage is set in the tank replacement position in this embodiment), "display exclusive mode" flashes the LED 101 of the ink tank to be replaced to clearly inform the user. The memory array 103B is not accessed, which prevents the problem of damaging the memory contents or the memory itself during the mounting/removing operation. In "memory access exclusive mode", by stopping the drive of the LED 101, unnecessary emission operation is prohibited, thereby restricting the power consumption.

Prohibition of the access operation may be performed by stopping or shutting off the power supply to the memory array 103B instead of or together with stopping to supply the clock signal.

In the above embodiment, the control code itself is divided into for memory access and for light-on/light-off control, thereby setting the codes in the respective modes. This invention is not limited to above, and a command for mode setting is separately prepared; the mode setting is performed; and a command for controlling the memory access or light-on/light-off is received to control each thereof.

Control Procedure (FIG. 17 to FIG. 24)

Figure 17:
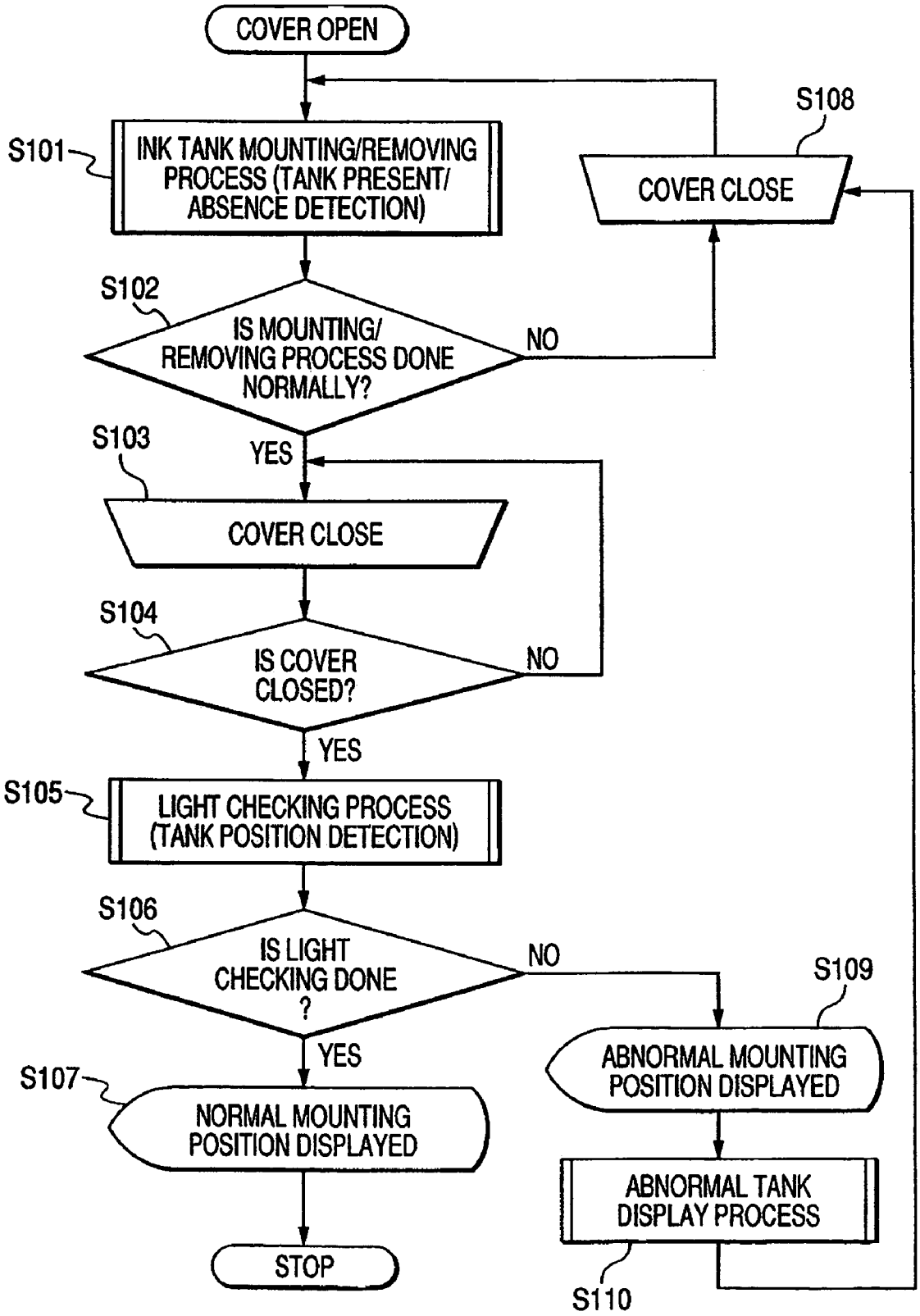
FIG. 17 is a flowchart of the control procedures for mounting and removing of the ink tank according to one embodiment of the invention.

FIG. 17 is the flowchart showing the control procedure relating to mounting/removing of the ink tank based on the structure of the above explained embodiment and especially showing the control of lighting-on/lighting-off of the LED 101 of the respective tanks 1K, 1Y, 1M, and 1C by the control circuit 300 at the main body side.

Figure 24:
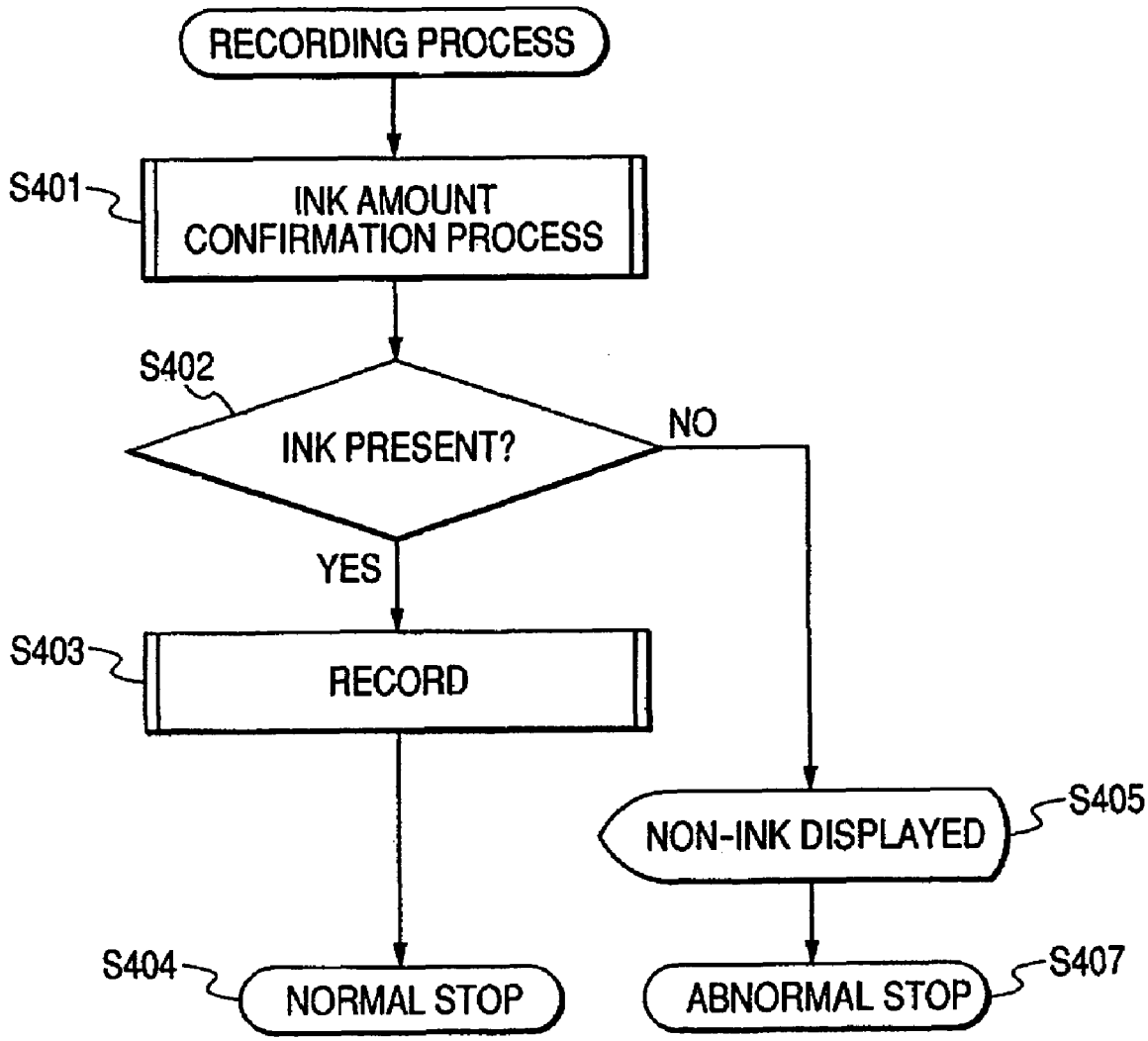
FIG. 24 is a flowchart showing the recording process according to the above embodiments.

The process shown in FIG. 17 shows the process that when the user opens the main body cover 201 of the printer of this embodiment, the predetermined sensor detects that condition and starts the process. When the process is started, firstly at step S101, the ink tank mounting/removing process is executed based on the determination of good or bad mounting condition of the ink tank 1 (namely, the mounting is complete or not) (detailed explanation of FIG. 18 to FIG. 21A). This process is used to mount a new ink tank or to replace the ink tank when no ink is indicated in the later explained recording process procedure (FIG. 24). Also, not only when the ink tank is to be mounted/removed, this process can be proceeded when the user decided to open the main body cover 201 for some reasons.

Upon completing the mounting process of the ink tank, step S102 determines whether the mounting/removing process was properly completed. If it is determined to be an abnormal stop, step S108 waits until the user opens the main body cover 201. Opening of the cover 201 starts the process of step S101, and the mounting/removing processes are repeated. On the other hand, at step S102, if it is determined that the mounting/removing process is finished normally, closing of the cover 201 is confirmed at step S103 and step S104.

After the mounting confirmation step, the process shifts to light checking process of step S105. An object of this light checking process is to check whether each ink tank normally mounted following the above procedure is properly positioned or not (FIG. 21B to FIG. 23D will be explained in detail). After the light checking process, at step S106, whether the process is normally finished or not is determined. If the light checking result shows normal finish, at step S107, for example the display device of the operation portion 213 emits a green light and this process is ended. On the other hand, if the light checking result shows abnormal finish, at step S109, for example the display device of the operation portion 213 flashes an orange light. Furthermore, at step S100, for example, the LED 101 of the ink tank, which is specified at step S105 not to be mounted in a proper position, can be flashed or lighted. Accordingly, at step S108, when the user opens the main body cover 201, the user can know about the ink tank that is not mounted in a proper position which encourages the user to remount the same in the proper position.

The mounting/removing process of the ink tank of the above procedure will be explained in detail below.

Figure 18:
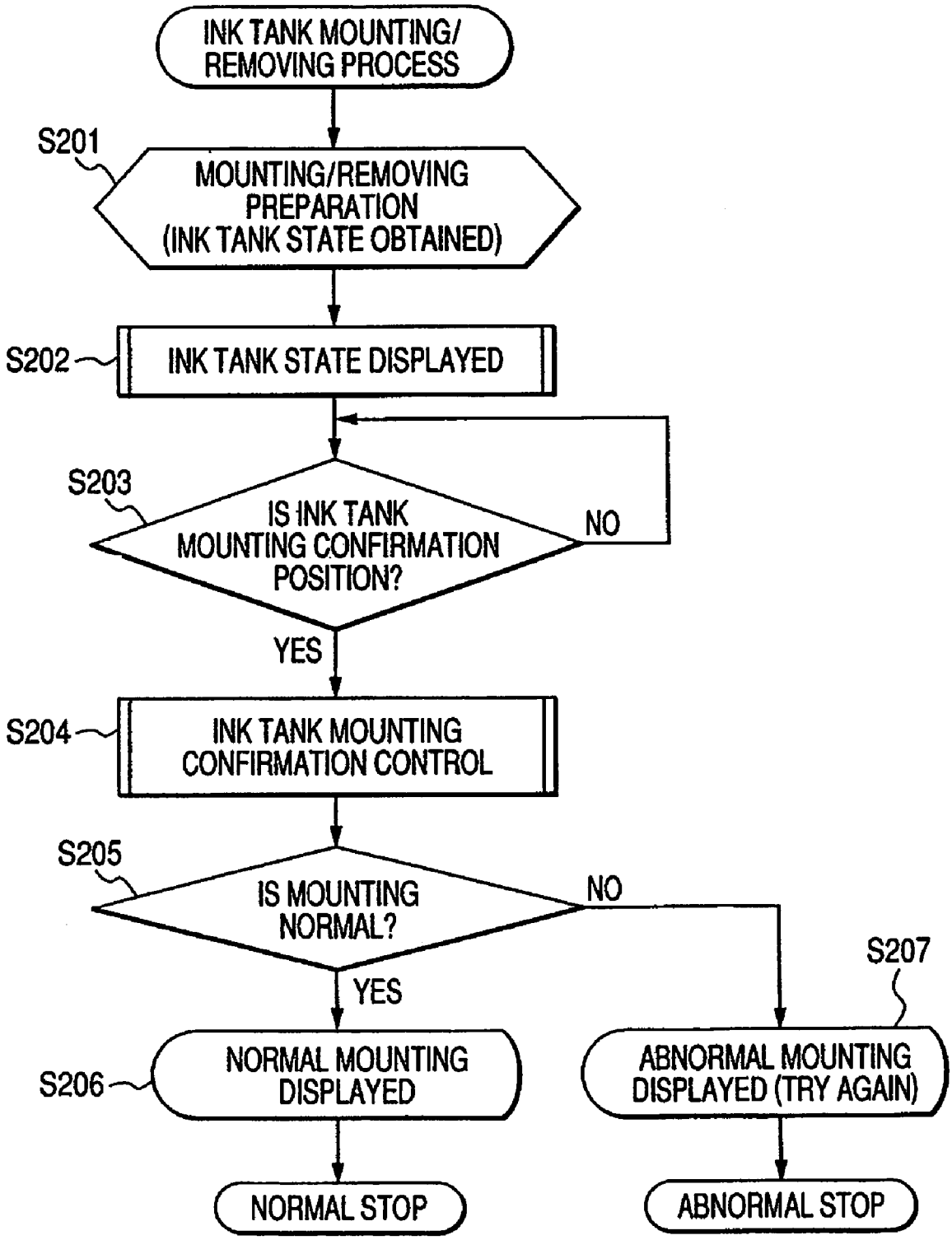
FIG. 18 is a flowchart showing the details of the process of mounting and removing of the ink tank in FIG. 17.

FIG. 18 is the flow chart showing the detail example of the mounting/removing process of the ink tank. As shown in FIG. 18, in the mounting/removing process, first, at the mounting/removing preparation process (step S201), the CPU 301 of the printer main body obtains the condition (individual information of the ink tank) of each ink tank mounted thereon. The information to be obtained thereat would be the current amount of the residual ink, which is read out together with the individual information of the ink tank from the memory array 103B. By receiving the command defining this read out operation as shown in FIG. 15, the controlling portion 103 mounted on the ink tank control board is switched to "memory access exclusive mode", and the driving of the LED 101 is not implemented.

After reading out of the memory array 103B, at step S202, the condition of the ink tank is displayed.

Figure 19:
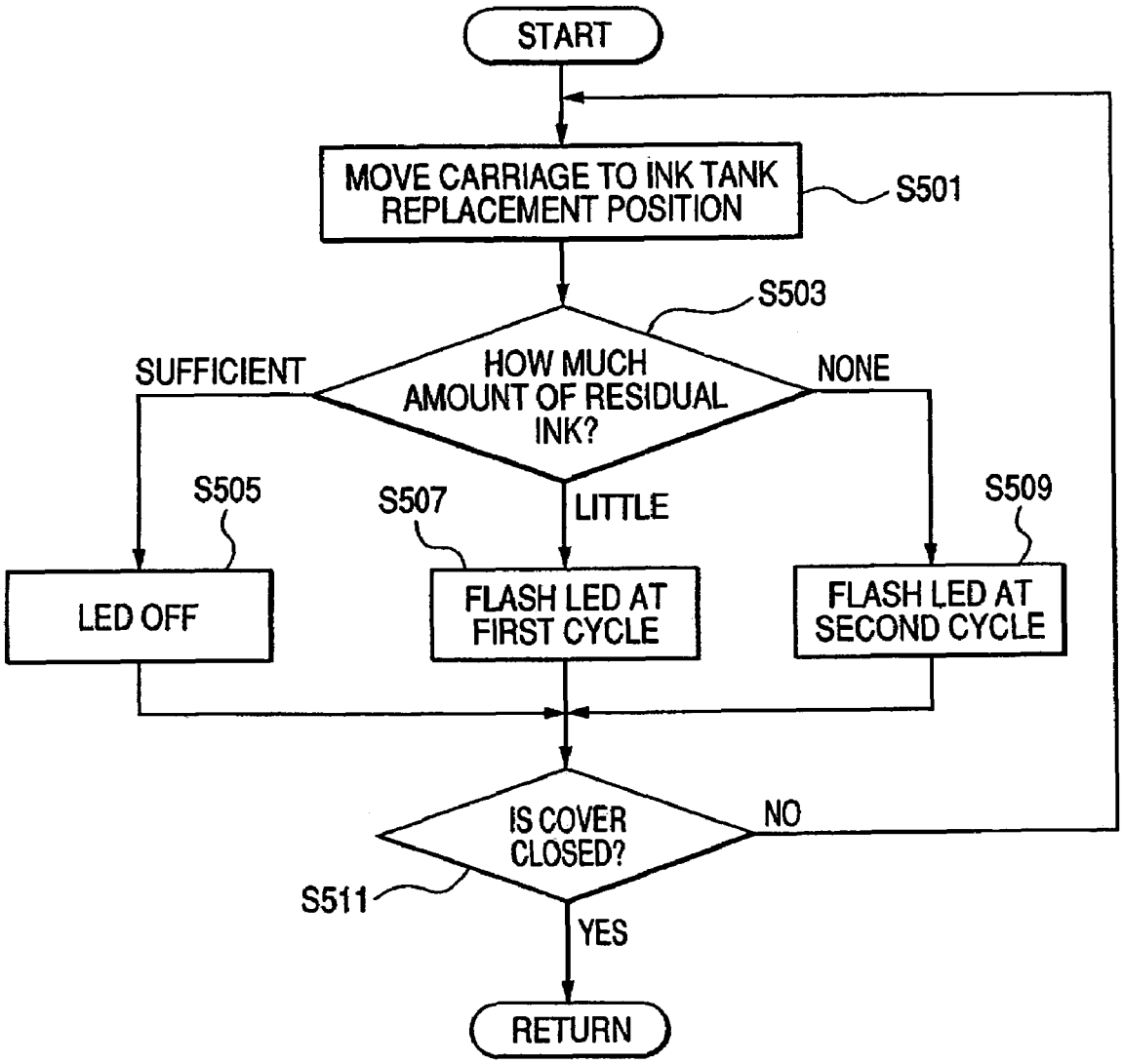
FIG. 19 is a flowchart showing the detail example of controlling the display of the condition of the ink tank in FIG. 18.

FIG. 19 shows the condition display process, where first the carriage 205 is moved to the ink tank change position (namely, the position where the user is able to mount/remove the ink tank) (step S501). Then, the LED 101 is driven in correspondence with the amount of the residual ink in the respective acquired ink tanks (steps S503 to S509). By receiving the command controlling light-on/light-off of the LED 101, the controlling portion 103 of the ink tank is switched to "display exclusive mode", thereby prohibiting the memory access.

As this embodiment of the LED 101 driving, as to the ink tank with sufficient amount of the residual ink, the LED 101 is not lighted (step S505) while as to the ink tank with little amount of the residual ink, the LED 101 flashes at the predetermined first cycle (step S507). Also, about the ink tank with substantially no residual ink, the LED 101 flashes at the second cycle that is different from the above first cycle (step S509). However, the embodiment of the LED driving is not limited to this explanation and may be arranged according to different situations. The LED can simply be controlled to light for a newly mounted ink tank. Furthermore, in the following section, this controlling process will be divided into three steps according to the amount of the residual ink to show the condition of the ink tank. However, for example, the controlling process can be two steps which is to see whether the ink is substantially existing or not. Alternatively, the controlling process can be more detail and be four or more steps. In any case, flashing at the different cycle corresponding to plural steps of the amount of the residual ink is effective.

After confirming the flashing condition, the user may remove the ink tank at his/her timing. Then, the power supply of the controlling portion 103 mounted on the ink tank substrate 120 is suddenly shut off. However, by receiving the command controlling the lighting-on/lighting-off of the LED 101, because the clock to the memory 103B is being stopped, the information recorded in the memory array 103B or the memory array 103 itself can be protected.

Then, when the user replace the ink tank and closes the main body cover 201 (step S511), the process goes back to the process in FIG. 18. Accordingly, the carriage is moved to the ink tank mounting confirmation position facing the first photoreceptor portion 210 (step S203), and the ink tank mounting confirmation control (step S204) is conducted.

Figure 20:
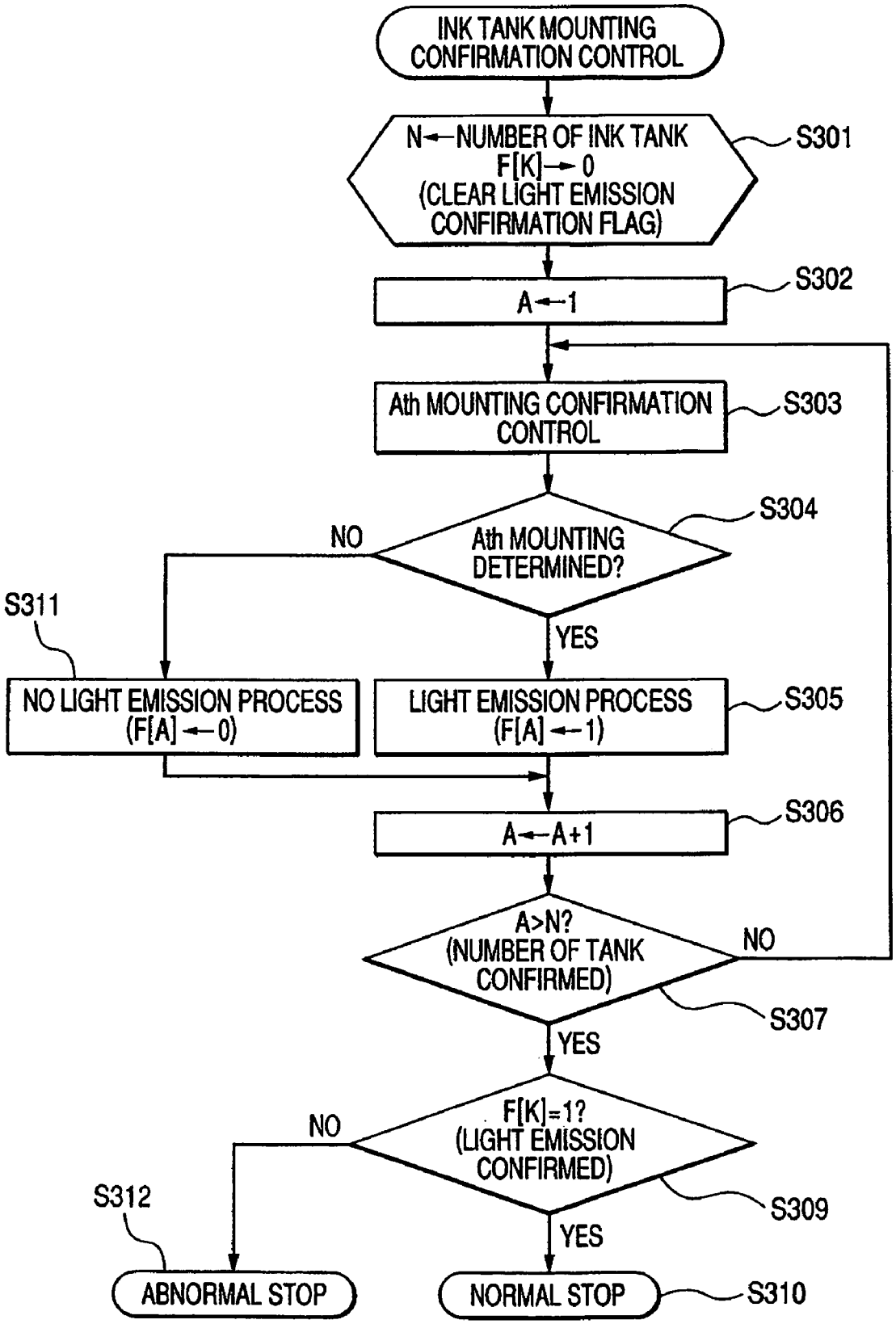
FIG. 20 is a flowchart showing the details of the mounting confirmation control in FIG. 18.

FIG. 20 is the flowchart explaining the details of the mounting confirmation control. First, in step S301, a parameter N indicating the number of the ink tank mounted on the carriage 205 is set and a flag F (k) for confirming the emission of the LED in correspondence to the number of the ink tank is initialized. In this embodiment, N is "4" representing the number of the ink tanks of K, C, M, and Y. Accordingly, four flags, F (k): k=1 to 4, are prepared, which are all initialized to make the content "0".

Next, at step S302, a variable A relating to the ink tank mounting determination order of the above flags is set to be "1", and at step S303, the mounting confirmation control relative to the ink tank relating to number "A" (number 1 or the first ink tank) is performed. As the user mounts the ink tank on the appropriate position of the holder 150 of the recording head unit 105, the above explained contact 152 of the holder 150 contacts with the contact 102 of the ink tank. Accordingly, as the control circuit 300 at the main body side specifies the above explained color information that is individual information of the ink tank, the color information stored in the memory array 103B of the specified tank is read out in order. Relative to the above color information to be specified, the information already read out is certainly not utilized. Furthermore, in this controlling process, the color information read out, after starting this process, is determined as to whether the color information is different from what has already been read out.

Then, at step S304, the color information can be read out and if the color information is different from what has been read out, the ink tank of the color information is determined to be the ink tank of A in the order. In other situations, it is determined that the ink tank of A in the order is not mounted. Here, A is simply an order of determining the ink tank and is not an order of the ink tank mounting position. If the ink tank of A in the order is determined to be mounted, at step S305, among the flag F (A), namely, the prepared 4 flags F (k) where k=1 to 4, the content of the flag corresponding to k=A is 1. Accordingly, as explained with FIG. 16, the corresponding LED 101 of the ink tank 1 of the color information is lighted. If the ink tank of A in the order is determined not to be mounted, at step S311, the content of the flag F (A) is 0. Also, if the mounting is not appropriate and the contact 152 of the holder 150 is not contacting with the contact 102 of the ink tank, the content of the flag F (A) remains "0".

Next, at step S306, the variable A is incremented by 1, and at step S307, whether the variable A is larger than N set at step S301 (N=4 in the printer of this embodiment) is determined. Here, if the variable A is determined to be N or less, the process after step S303 is repeated. If it is determined that the variable A is larger than N, whether the content relative to all 4 flags F (K) where k=1 to 4 is "1" or not, namely, whether the LEDs 101 for all ink tanks are lighted is determined. If it is determined that no LED 101 of any ink tank is lighted, at step S312, the abnormal condition status is returned to the process routine in FIG. 18 and this process is ended.

Figure 21A:
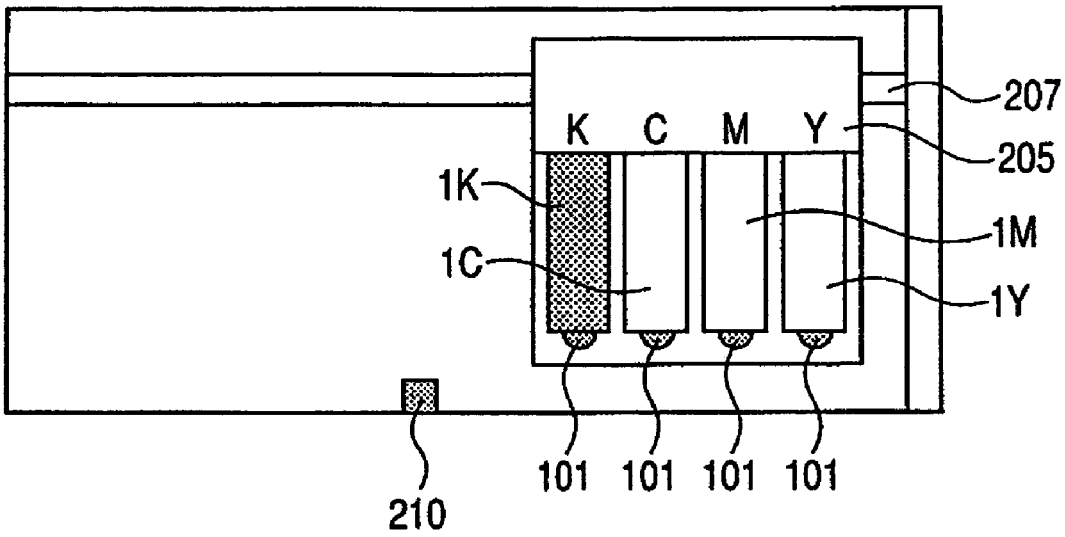
FIG. 21A is a view showing the condition in controlling the mounting and removing of the above ink tank where all ink tanks are properly mounted and the respective LEDs is lighted.

If it is determined that the LEDs of all ink tanks are lighted, at step S310, normal ending operation is conducted to end the process, and the process is returned to the process routine as shown in FIG. 18. FIG. 21A shows the condition that all ink tanks are properly mounted and each LED is lighted.

When FIG. 18 is referred to again, after performing the ink tank mounting confirmation control at step S203 as above, at step S204, whether the control is normally ended or not, namely, whether the ink tank was normally/properly mounted or not, is determined. If it is determined that the ink tank is properly/normally mounted, at step S205, the display device (FIG. 9 and FIG. 10) of the operation portion 213, for example, shows the green light on, and the process ends normally at step S206 to return to the process routine as shown in FIG. 17. If it is determined that the mounting is abnormal, at step S207, the display device of the operation portion 213 for example shows a flashing orange light, and the process ends abnormally at step S208 to return to the process routine as shown in FIG. 17. The host PC controlling the recording apparatus is connected, the mounting abnormal display can be shown on the PC monitor simultaneously.

Here, the main body cover 201 is opened in order to remount the ink tank, and when the ink tank mounting/removing process is performed, the LED of the ink tank properly mounted is controlled to flash. Accordingly, this will alert the user that the ink tank is not mounted or not properly mounted (namely, the contact 152 of the holder 150 is not contacting with the contact 102 of the ink tank 1).

The details of the light checking process (step S105) in the procedure of FIG. 17 will be explained next.

The light checking process is to determine whether each ink tank properly mounted is mounted in a proper position or not. In this embodiment, because the shape of the ink tank is not changed for each color, it is possible that the user mistakenly mounts the ink tank of each color on a not assigned position. Accordingly, this light checking process is performed and if any ink tank is mounted on the not assigned position, the user would be notified as such. Accordingly, especially, without changing the shape of the ink tank for every different color, the invention can realize the effective ink tank manufacturing and lowering the cost.

Figure 21B:
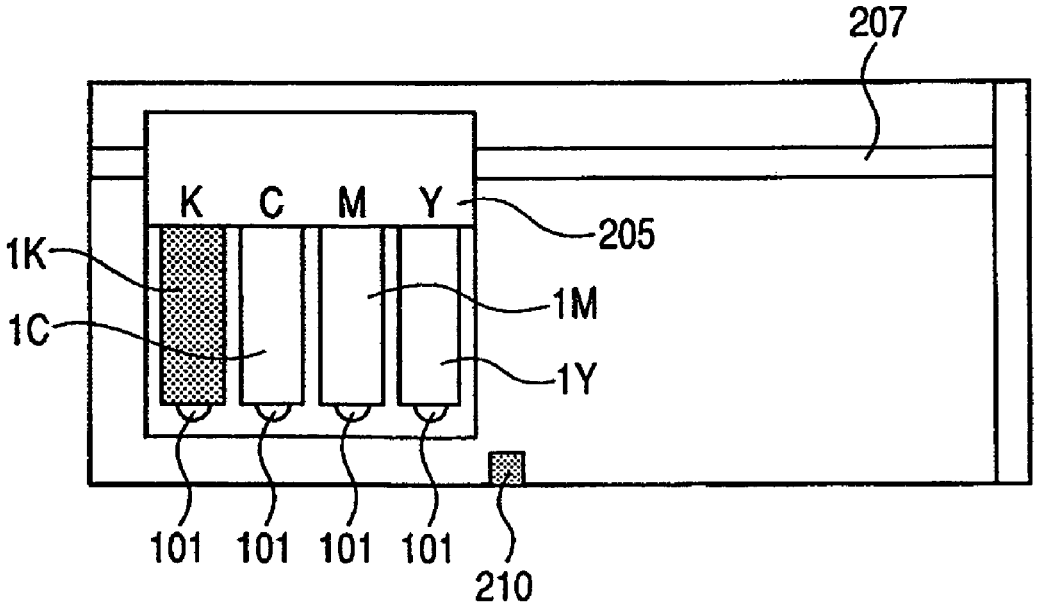

In this light checking process, at first, whether the main body cover 201 is closed or not is confirmed (steps S103 and S104 of FIG. 17). Then, as shown in FIG. 21B, the carriage is moved for the light checking and the LED 101 of each tank with the light on is turned off.

FIGS. 22A to 22D and FIGS. 23A to 23D show the light checking process thereafter.

Figure 22A:
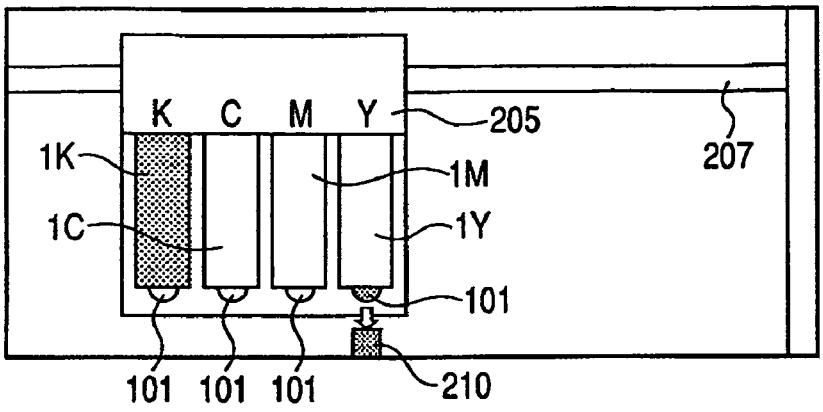
FIGS. 22A, 22B, 22C and 22D are views explaining the light checking process.

As shown in FIG. 22A, at first, the carriage 205 begins to move from the left to the right relative to the first photoreceptor portion 210. Then, the LED 101 of the ink tank 1Y emits the light where the ink tank at the position, where the ink tank containing the yellow ink is to be mounted, is facing with the first photoreceptor portion 210. As explained with FIG. 16, in this light checking process, the LED light is also turned off after the predetermined time. When the ink tank is mounted on the normal position, the first photoreceptor portion 210 can intercept the emitted light of the LED 101, and the control circuit 300 determines whether the ink tank 1Y is properly mounted on the mounting position.

Figure 22B:
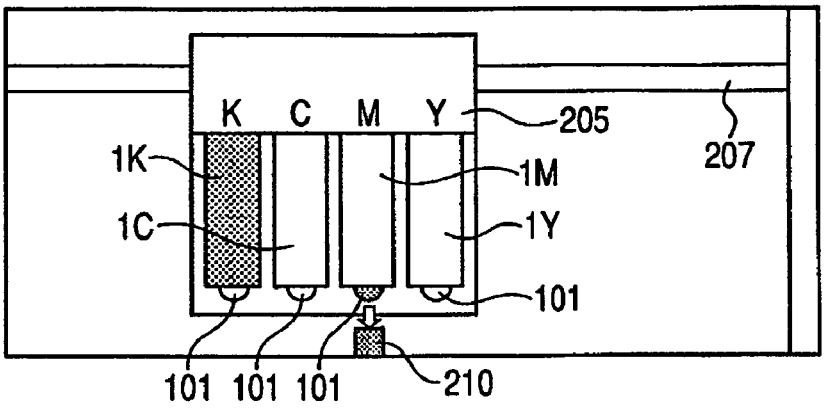
Figure 22C:
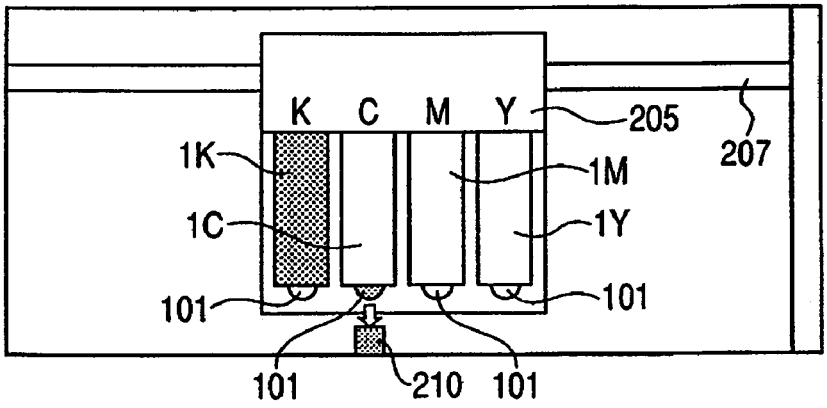
Figure 22D:
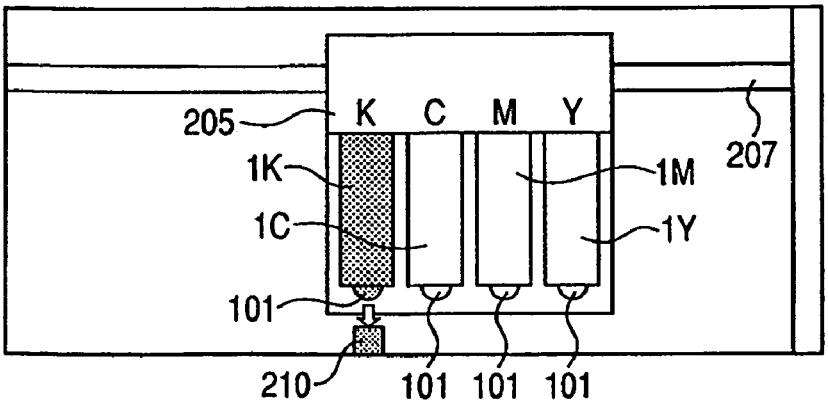

As moving the carriage 205, similarly, the LED 101 of the ink tank 1M emits the light where the ink tank at the position, where the ink tank 1M containing the magenta ink is to be mounted, is facing with the first photoreceptor portion 210 as shown in FIG. 22B. The example in FIGS. 22A to 22D shows that the ink tank 1M is mounted on the proper position and the first photoreceptor portion 210 intercepts the emitted light. As shown in FIGS. 22B to 22D, the emission is performed as changing the mounting position for the determination. These figures show an example of the ink tank properly mounted.

Figure 23A:
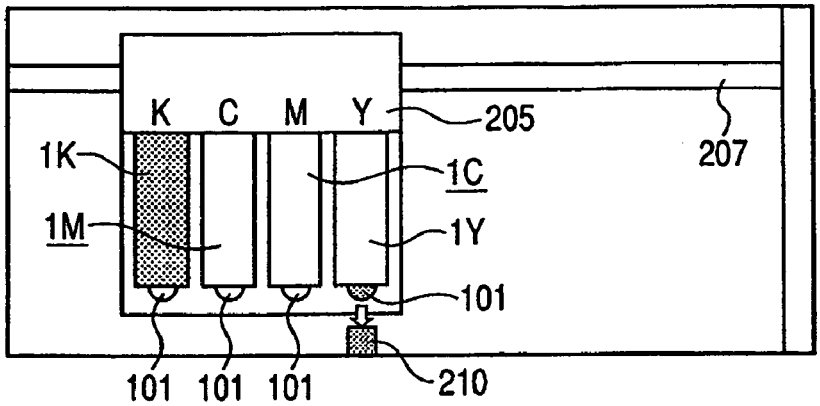
FIGS. 23A, 23B, 23C and 23D are views similarly explaining the light checking process.
Figure 23B:
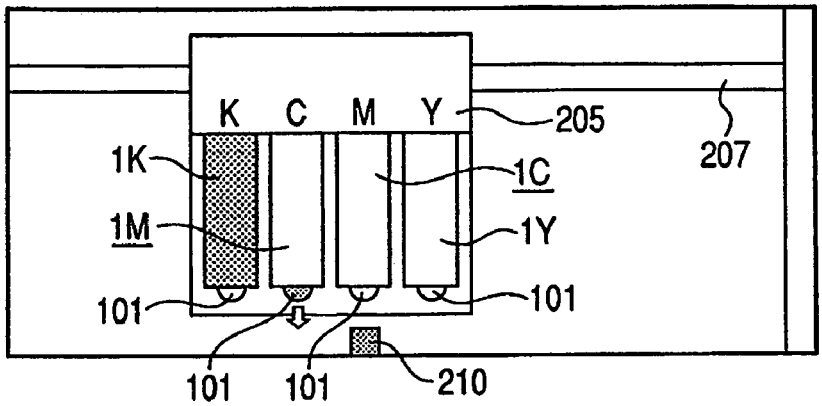
Figure 23C:
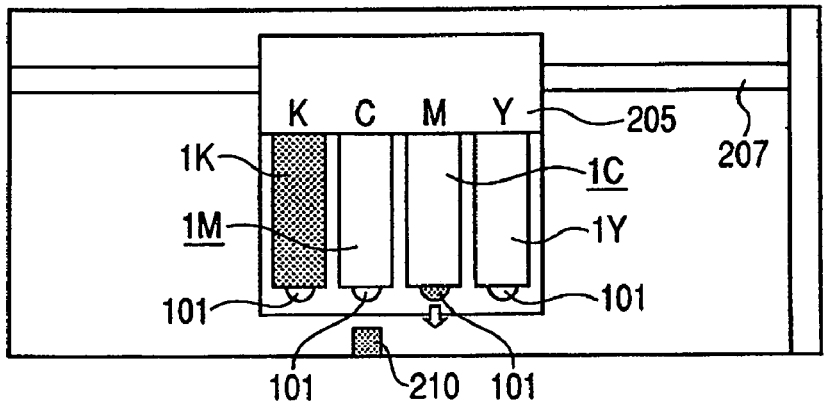
Figure 23D:
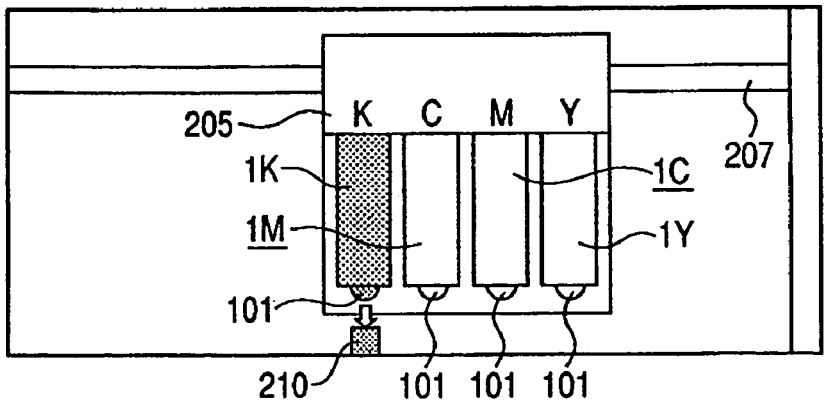

As shown in FIG. 23B, if the ink tank 1C containing cyan ink is mistakenly mounted on the position where the ink tank 1M containing magenta ink is to be positioned, the LED 101 of the ink tank 1C facing the first photoreceptor portion 210 does not emit the light. However, the LED 101 of the ink tank 1M mounted on another position emits the light. As a result, because the first photoreceptor portion 210 cannot intercept the light at this timing, the control circuit 300 determines that the ink tank other than the ink tank 1M is mounted on the mounting position. On the other hand, as shown in FIG. 23C, the ink tank 1M containing the magenta ink is mistakenly mounted on the position on which the ink tank 1C containing the cyan ink is supposed to be mounted, and therefore the LED 101 of the ink tank 1M facing the first photoreceptor portion 210 does not emit the light. However, the LED 101 of the ink tank 1C mounted on another position emits the light.

By performing the above explained light checking process, the control circuit 300 can specify the ink tank which is not mounted on the originally assigned position. Also, if the ink tank is not mounted on the proper mounting position, other ink tanks of three colors are controlled to be lighted in order. Accordingly, it is possible to specify the ink tank with a certain color mistakenly mounted on that position. Then, after the above light checking process, the above explained step S106 in FIG. 17 is processed.

As such, the user can record desirably using the printer with the properly and normally mounted ink tanks thereon.

FIG. 24 is the flowchart showing the recording process of this embodiment. In this process, firstly, in step S401, the ink amount confirming process is conducted. This process, relative to the recording job, is to determine the recording amount from the recording data, to compare the recording amount with the amount of the residual ink in each ink tank, and to determine whether the ink amount is sufficient to perform the recording job. Also, in this process, the above ink amount is the amount determined by the control circuit 300 counting the current residual amount.

In step S402, whether the ink amount is sufficient or not is determined based on the above confirming process. If there is sufficient ink, recording operation is performed at step S403, and the display device of the operation portion 213 lights in green to finish normally at step S404. On the other hand, at step S402 if it is determined that the ink amount is not sufficient, in step S405, the display device of the operation portion 213 flashes the orange light to finish abnormally. Accordingly, by opening the main body cover 201, the process shown in FIG. 17 can be started.

According to the above structure, without the display function of the recording apparatus itself or the host computer which controls the recording apparatus, or without using thereof, the user can confirm the information relating to the ink tank by the display function in the ink tank itself. Then, as explained above, the structure of this embodiment allows to inform of the life of the cartridge and the timing for the ink replacement as well as various information including but not limited to whether the mounting of the cartridge is certainly and properly mounted by utilizing the light emitting portion. As such, the light emitting portion can have a various applications, and the possibility of utilizing the same is extremely high.

Figure 25:
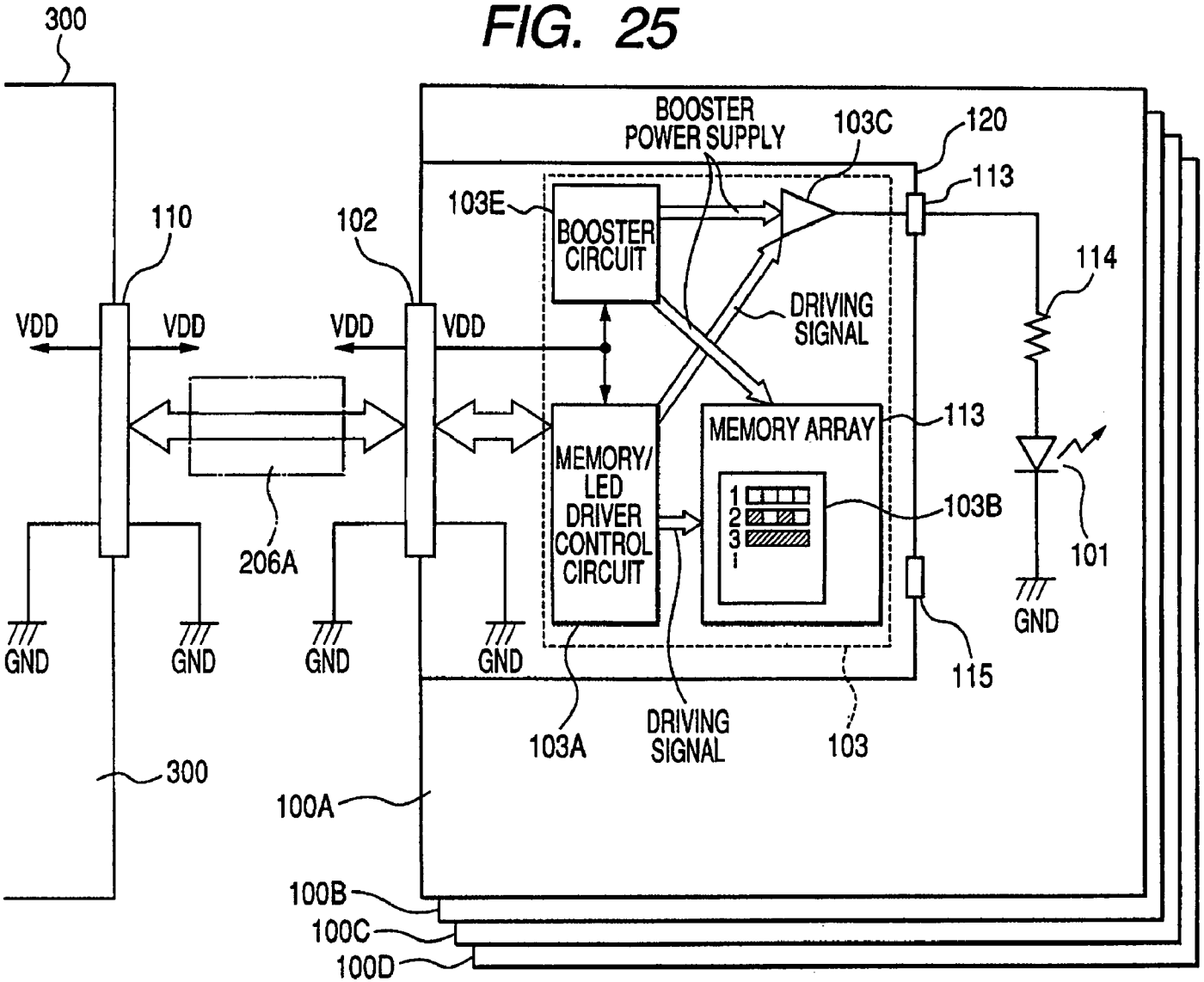
FIG. 25 is a circuit view showing a modification example of the structure of FIG. 13.
Figure 26C:
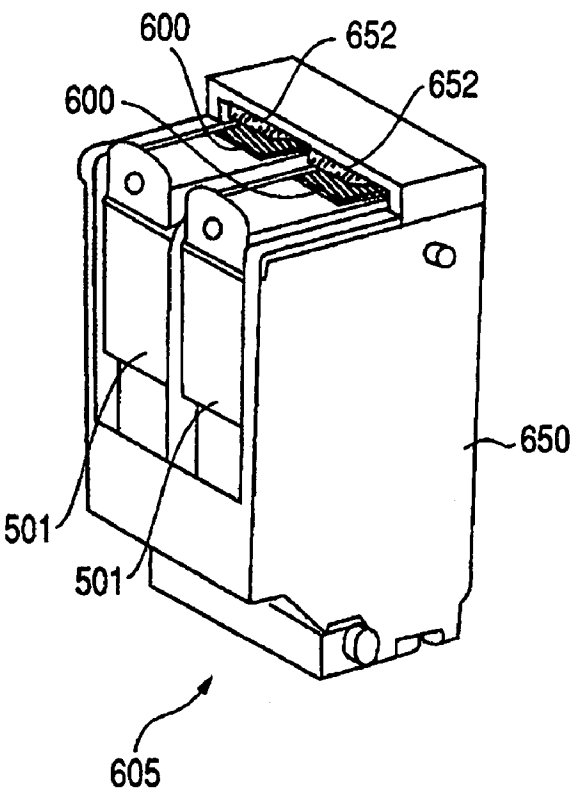
FIGS. 26A, 26B and 26C are views explaining an example of the structure of mounting portion and the ink tank according to another embodiment of the invention and the mounting operation thereof.
Figure 26B:
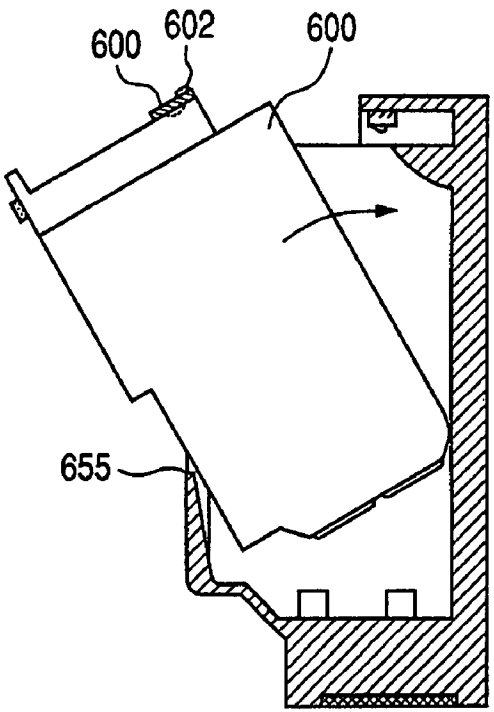
Figure 26A:
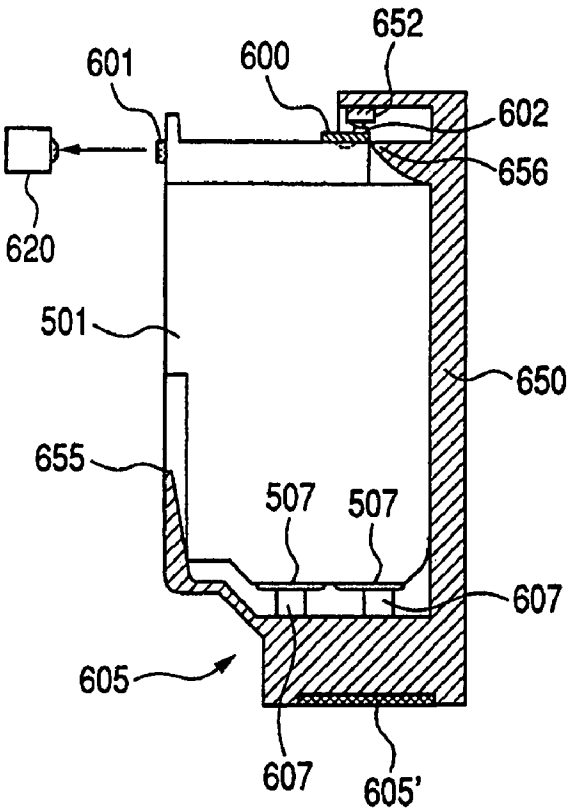
Figure 27:
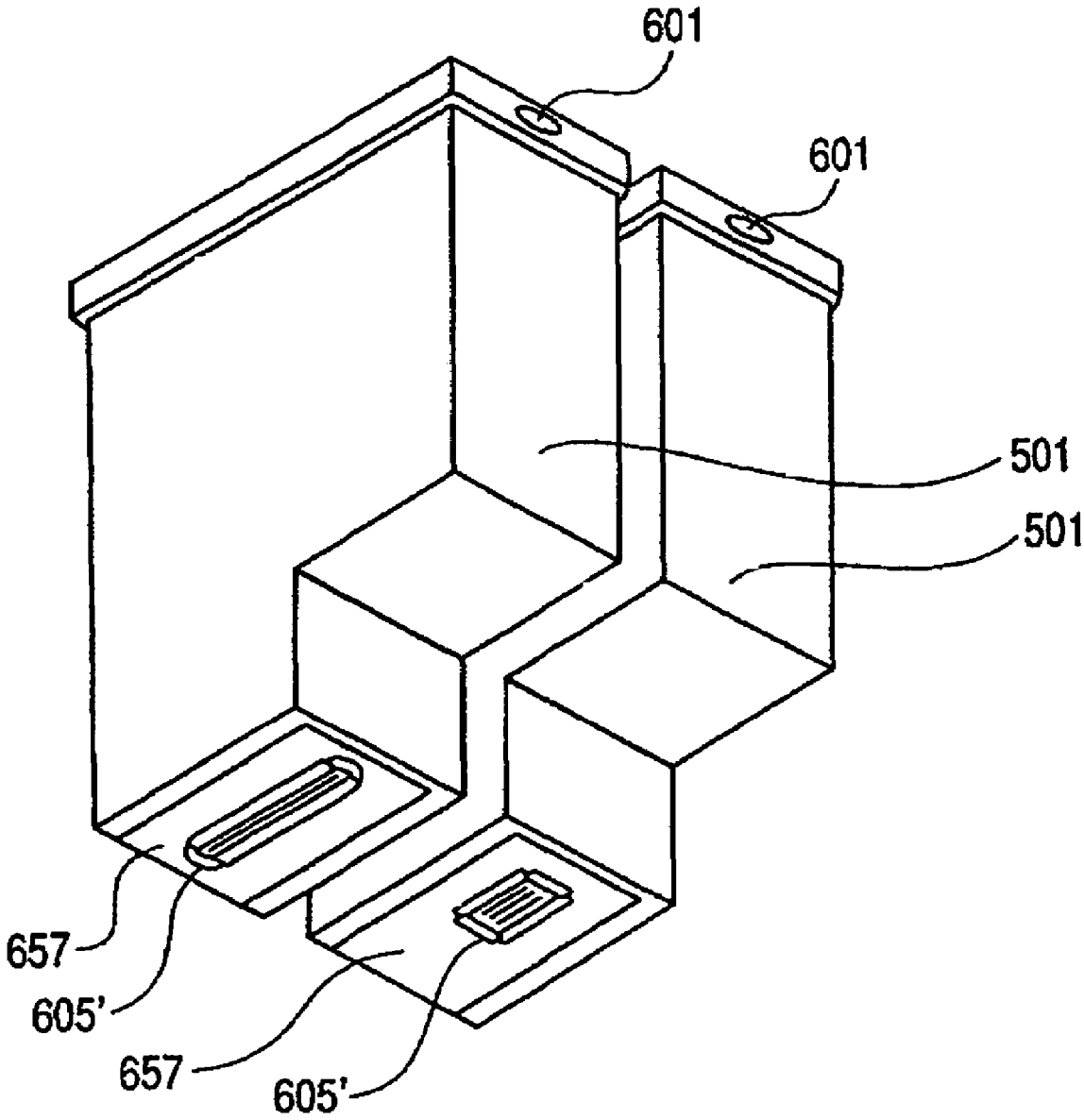
FIG. 27 is a perspective view of the modification example of the structure of FIGS. 26A to 26C.

Another Embodiments (FIG. 25 to FIG. 27)

In the above embodiments, relatively high power supply voltage VDD is supplied from the main body of the recording apparatus side to the memory array 103B and the LED 101. Also, the lowered pressure voltage is supplied to the memory/LED driver control circuit 103A which operates with relatively low voltage by the voltage lower circuit 103D. However, the power supply voltage to be supplied and the circuit structure for changing the voltage level on the substrate, can be determined as necessarily, corresponding to the structure at the main body of the recording apparatus side and the structure of the elements arranges on the substrate.

FIG. 25 is the circuit view of the modification example of the structure in FIG. 13. A difference between this modification example and the example in FIG. 13 is that the voltage, which is the same level of the power supply voltage VDD to drive the memory/LED driver control circuit 103A is supplied from a single power line. On the other hand, the voltage supplied for the operation of the memory array 103B and the LED 101 is the boosting power supply voltage VDD by the booster circuit 103E. In this case, appropriate and sufficient power of the voltage with the power supply from a single power line by the bus connection can be supplied to the plural elements with different driving voltage (in this embodiment, which are the memory/LED driver control circuit 103A and the memory array 103B, and the LED 101). Also, the memory/LED driver control circuit 103A which is the constantly driving controlling portion can be driven with the lower voltage. Furthermore, the memory/LED driver control circuit 103A drives the memory array 103B access and LED drive at the appropriate timing, thereby realizing the power saving effect.

Also, for example, an informing portion such as the LED 101, an information retention portion such as the memory array 103B, and the controlling portion such as the memory/LED driver control circuit 103A may be driven with different voltages. In that case, appropriate voltage level on the substrate can be modified by two or more voltage lower control circuits, two or more booster circuits, or combination of the voltage lower control circuit and the booster circuit.

Furthermore, in the above embodiments, the light emitting portion as the informing means to inform the conditions of the ink tank is LED; however, other lamps or light emitting parts may be used. Also, display portions such as liquid crystal display element may be used to show the information by letters and figures in addition to the simple emission. Furthermore, displacement, deformation, and discoloration may be used to inform instead of the light emitting parts. In addition to these, visual sense and other sound such as beeping sound may be used to inform. That is, this informing is not limited to the one using the visual sense and can be anything to stimulate the sense of human being by various ways such as using auditory sense, thereby using appropriate informing portion for the particular situation. However, in any situation, it is preferable that the user can specify each of plural ink tanks to be mounted and specify the plural conditions that each of plural ink tank can take. This invention can be applied to the informing portions with any driving voltage.

Also, the above embodiment explains the structure of the ink tank holder with the integrated recording head cartridge, but the ink tank holder is not limited to the particular structure. That is, the ink tank holder can be separated from the recording head as long as the ink tank holder is able to supply the ink toward the recording head obtaining the ink communication when the ink tank is mounted.

The number and shapes of the ink tank and holder and structures of the recording unit or the ink jet recording apparatus in which the ink tank is installed, are not limited to the above explanation. Also, the colors of the ink are not limited and may be single or multiple colors. Furthermore, the ink tank may contain, in addition to the ink as the color material, a processing liquid for improving the fixability, coloring, and durability on the recording medium.

Still further, in the above explained first embodiment, the first engaging portion 5 at the back surface side of the ink tank penetrates the first looking portion 155 first looking portion 155 at the back side of the holder, and the while pressing down the front face side of the ink tank, the ink tank 1 is rotated with the penetrating portion as a pivot point for the installation thereof. Preferable positioning of the substrate 100 for this operation is a position at the front face side away from the pivot point, and as such the first photoreceptor portion 210 and the first light emitting portion 101 also used for emitting light to the eyes of the user are integrated on the substrate 100.

However, the preferable positioning of the substrate and positioning required for the light emitting portion may be different depending upon the structures of the ink tanks and the installation portions, and in that case, the substrate and the light emitting portion may be disposed as appropriate. That is, both members are not necessarily integrated.

FIGS. 26A to C are views explaining the structural example and the mounting operation of the ink tank and the installation portion according to another embodiment of the invention.

In FIG. 26A, the ink tank 501 of this embodiment has the light emitting portion 601 such as the LED arranged at the upper front face thereof and the substrate 600 with the pad 602 on the back side of the upper surface thereof. Accordingly, when the light emitting portion 601 emits the light, the lighting comes from the front face side. Here, the photoreceptor portion 620 is arranged at the end of the carriage scanning/moving range and at the position where the light emitting from the left side of FIG. 26A is intercepted, and the light emitting from the light emitting portion 601 is controlled when the carriage is positioned at its portion. Accordingly, the recording apparatus side can recognize the certain information relating to the ink tank 501 from the content of the light interception of the photoreceptor portion. Also, for example, by positioning the carriage at the central region of the scanning/moving range and controlling the emission of the light emitting portion 601, the user can recognize the certain information relating to the ink tank 501 by viewing the emitting state.

The recording head unit 605, as shown in FIG. 26C, comprises the holder 650 mountably/removably retaining the plural ink tanks (2 ink tanks in FIG. 26C) and the recording head 605' to be positioned at the bottom surface side thereof. As the ink tank 501 is mounted on the holder 650, the ink inlet 607 positioned at the recording head side around the bottom portion of the holder and the ink supply port 507 positioned at the bottom of the ink tank are jointed, thereby forming the ink communication path therebetween. The holder 650 has the engagement portion 655 functioning as the rotation center of the ink tank 501 when mounting thereof at the front face side and the engagement portion 656, engaging the ink tank 501 at the mounting complete position, around the upper back surface side thereof. Also, the connector 652 to be connected with the pad 502 of the substrate 500 is positioned adjacent to the engagement portion 656.

When the ink tank 501 is mounted on the recording head unit 605, the ink tank 501 is handled from the front face of the holder 650. As shown in FIG. 26B, as pressing the lower end portion of the back surface of the ink tank against the back surface of the holder 650, the member at the front face of the ink tank is being engaged with the engagement portion 655 of the holder 650. Under this condition, if the upper portion of the front face of the ink tank 501 is pressed in the direction of the back surface, the ink tank 501 rotates in the direction of the arrow with the engagement portion 655 as the fulcrum and is mounted in the holder. FIGS. 26A and 26C shows the mounting complete condition of the ink tank 501, where the ink supply port 507 is being connected with the ink inlet 607 and the pad 602 is being connected with the connector 652. Also, the pad 602 and the connector 652 are positioned at the furthest away from the rotation center when mounting, and the two members abut against each other immediately prior to the completion of the mounting process, thereby providing the mounting complete condition while maintaining excellent electric connection therebetween.

The engagement portion 655 and the engagement portion 656 at the holder 650 side and the structure of the ink tank 501 side corresponding thereto may be determined as necessary. In the examples of the figures, the substrate 600 is provided on the surface parallel to the upper surface of the ink tank 501 but as shown in the first embodiment, may certainly be provided on a slant surface. Furthermore, the holder 650 and the related structural members may be incorporated in the head unit.

FIG. 27 is a perspective view showing the modification example of the structure of FIGS. 26A to 26C, which shows two recording head units (liquid container cartridges) of the ink tank 501 and the recording head 605' which are structurally integrated. In this embodiment, one cartridge is for black ink and the others are yellow, magenta, and cyan inks.

To comply with the structure, the carriage with the same structure as in the above-mentioned holder 650 may be used. In this embodiment, the control circuit of the light emitting portion 601 positioned at the front face side is structured on the substrate positioned at an appropriate portion of the head unit. However, the control circuit is formed on the drive circuit substrate integrated with the recording head 605', which is connected to the light emitting portion 6.01 via the wiring, not shown in the figures. Here, the drive circuit of the recording head 605' and the control circuit of the light emitting portion 601 are connected to the electric connecting point at the carriage side via the wiring section 657 and the electric connecting point not shown in the drawing.

Figure 28:
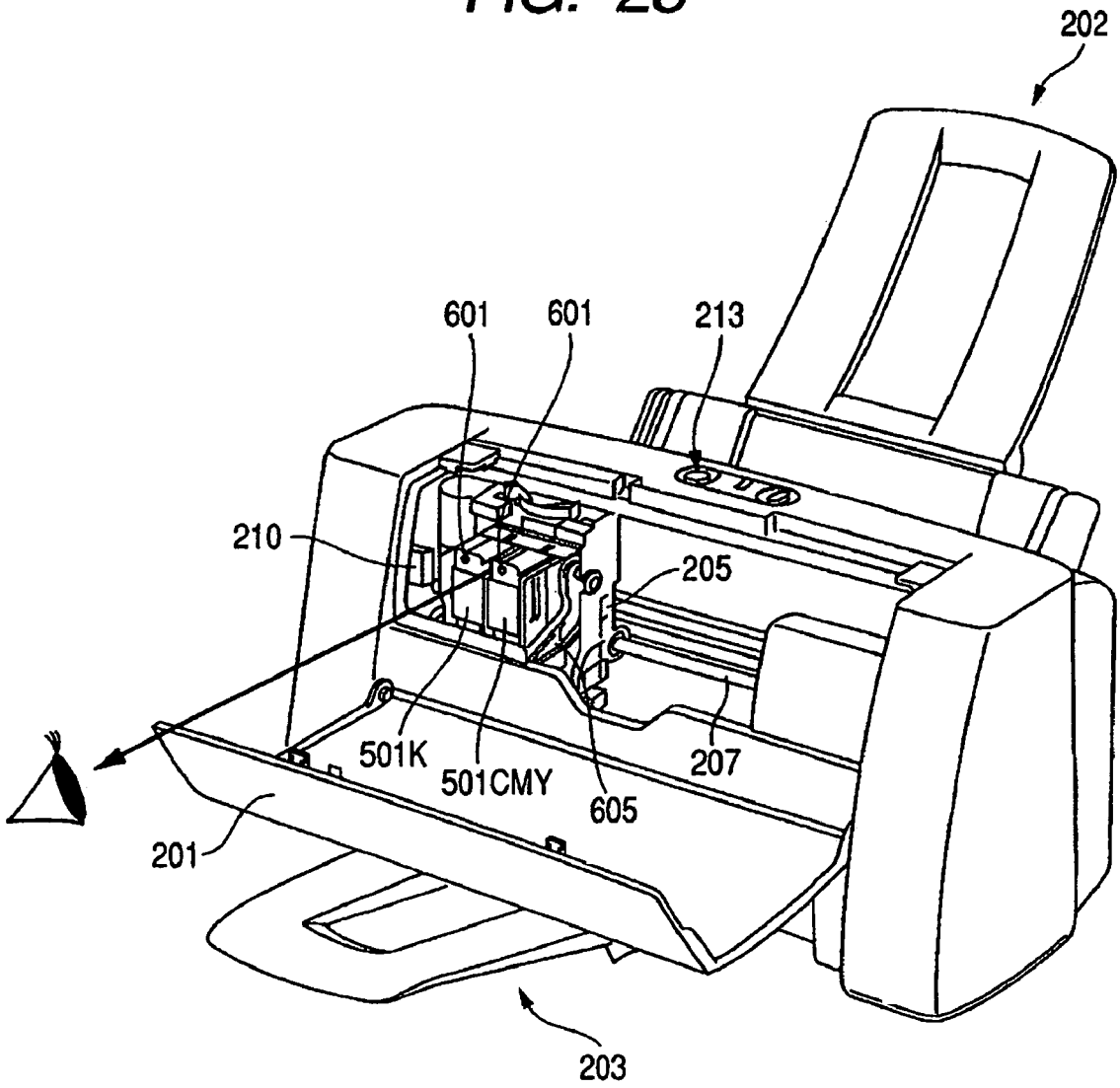
FIG. 28 is a perspective view of the printer which records as mounting the ink tanks with the components according to the above another embodiment.

FIG. 28 is the perspective view of the printer which records as having the ink tank with the structure relating to the above explained other embodiment, and the figure shows the condition that the main body cover is open. In the same figure, same elements used such as in FIG. 10 and FIG. 11 have the same reference numerals and the explanations of which are not repeated.

As shown in FIG. 28, the ink tank 501K containing the black ink and the ink tank 501CMY integratedly formed and each container containing cyan, magenta, and yellow, each is mounted on the holder of the recording unit 605 on the carriage 205. Then, as explained above, in each ink tank, the LED 601 is provided separately from the LED 601, and while the ink tank is being mounted (the ink replacement position), the user may come to the front face to view the LED 601. Also, corresponding to the position of the LED, the photoreceptor position 210 is provided adjacent to one end of the moving range of the carriage 205.

This application claims priority from Japanese Patent Application No. 2004-374485 filed Dec. 24, 2004, which is hereby incorporated by reference herein.

What is claimed is:

1. A liquid container mountable on and removable from a recording apparatus which is capable of mounting plural liquid containers, and has a apparatus side contact point electrically connectable to a contact point of the liquid container and an electric circuit electrically being connected to the apparatus side contact point and having a wiring to supply a power supply voltage to the plural liquid containers, the liquid container further comprising:

the contact point electrically connectable to the apparatus side contact point;

an information retention portion capable of retaining at least an individual information with respect to the liquid container;

an informing portion;

a driving portion for driving the informing portion;

a controlling portion capable of accessing the information retention portion in response to a command containing the individual information from the recording apparatus and performing a drive control of the driving portion so as to inform a condition of the liquid container; and voltage level changing means for supplying the voltage as changing a level of the power supply voltage relative to at least one of the controlling portion, the informing portion, and the information retention portion according to the voltage necessary for driving the controlling portion, the informing portion, and the information retention portion.

2. The liquid container according to claim 1, wherein the power supply voltage is supplied to the informing portion and information retention portion, and the voltage level changing means has a voltage lower control circuit which lowers and supplies the power supply voltage relative to the controlling portion.

3. The liquid container according to claim 1, wherein the power supply voltage is supplied to the controlling portion, and the voltage level changing means has a booster circuit which raises and supplies the power supply voltage relative to the informing portion and the information retention portion.

4. The liquid container according to claim 1, wherein the controlling portion separately performs driving of the informing portion and accessing of the information retention portion in response to commands including a controlling code for driving the informing portion and a command including a control code for accessing the information retention portion.

5. The liquid container according to claim 4, wherein a command length including the control code for accessing the information retention portion is not identical to a command length including the control code for driving the informing portion.

6. The liquid container according to claim 1, wherein the information retention portion, the informing portion, the driving portion, and the controlling portion are positioned on the same circuit board.

7. The liquid container according to claim 1, wherein the liquid container contains ink.

8. The liquid container according to claim 1, wherein the informing portion is a light emitting portion.

9. A circuit module installed in a liquid container mountable on and removable from a recording apparatus which is capable of mounting plural liquid containers and has an apparatus side contact point electrically connectable to a contact point of the liquid container and an electric circuit electrically being connected to the apparatus side contact point and having a wiring to supply a power supply voltage to the plural liquid containers, the circuit module comprising:

the contact point electrically connectable to the apparatus side contact point;

an information retention portion capable of retaining at least an individual information with respect to the liquid container;

an informing portion;

a driving portion for driving the informing portion;

a controlling portion capable of accessing the information retention portion in response to a command containing the individual information from the recording apparatus and performing a drive control of the driving portion so as to inform a condition of the liquid container; and voltage level changing means for supplying the voltage as changing a level of the power supply voltage relative to at least one of the controlling portion, the informing portion, and the information retention portion according to the voltage necessary for driving the controlling portion, the informing portion, and the information retention portion.

10. A circuit board installed in a liquid container mountable on and removable from a recording apparatus which is capable of mounting plural liquid containers and has an apparatus side contact point electrically connectable to a contact point of the liquid container and an electric circuit electrically being connected to the apparatus side contact point and having a wiring to supply a power supply voltage to the plural liquid containers, wherein the circuit module according to the claim 9 is integrated with the informing portion.

11. A recording apparatus capable of mounting the liquid container according to claim 1 thereon, wherein the recording apparatus comprises an apparatus side contact point electrically connectable to each contact point of the plural liquid containers and an electric circuit including the wiring for supplying the power supply voltage and a wiring commonly making electrical with the plural apparatus side contact points.

12. A liquid supply system comprising a liquid container mountable on and removable from a recording apparatus which is capable of mounting plural liquid containers, and has an apparatus side contact point electrically connectable to a contact point of the liquid container and an electric circuit electrically being connected to the apparatus side contact point and having a wiring to supply a power supply voltage to the plural liquid containers, and the liquid container mountable on and removable from a carriage of the recording apparatus, wherein the liquid container comprises:

the contact point electrically connectable to the apparatus side contact point;

an information retention portion capable of retaining at least an individual information with respect to the liquid container;

an informing portion;

a driving portion for driving the informing portion;

a controlling portion capable of accessing the information retention portion in response to a command containing the individual information from the recording apparatus and performing a drive control of the driving portion so as to inform a condition of the liquid container; and voltage level changing means for supplying the voltage as changing a level of the power supply voltage relative to at least one of the controlling portion, the informing portion, and the information retention portion according to the voltage necessary for driving the controlling portion, the informing portion, and the information retention portion.

* * * * *

UNITED STATES PATENT AND TRADEMARK OFFICE

CERTIFICATE OF CORRECTION

PATENT NO. : 7,354,144 B2
APPLICATION NO. : 11/304603
DATED : April 8, 2008
INVENTOR(S) : Nobuyuki Hatasa, et al.

It is certified that error appears in the above-identified patent and that said Letters Patent is hereby corrected as shown below:

TITLE PAGE, ITEM [57] ABSTRACT

Line 12, “changing menas” should read --changing means--.

COLUMN 11

Line 40, “fix” should read --fixes--.

COLUMN 19

Line 67, “most left” should read --leftmost--.

COLUMN 28

Line 32, “6.01” should read --601--; and
Line 62, “a” should read --an--.

COLUMN 29

Line 59, “electrically being” should read --being electrically--.

COLUMN 30

Line 21, “electrically being” should read --being electrically--;
Line 24, “the claim 9” should read --claim 9--;
Line 32, “electrical” should read --electrical connection--; and
Line 39, “electrically being” should read --being electrically--.

Signed and Sealed this

Twenty-third Day of September, 2008

JON W. DUDAS
*Director of the United States Patent and Trademark Office*